US009366161B2

(12) United States Patent
Morehead et al.

(10) Patent No.: US 9,366,161 B2
(45) Date of Patent: Jun. 14, 2016

(54) HYDRAULIC VALVE FOR AN INTERNAL COMBUSTION ENGINE

(71) Applicant: Hilite Germany GmbH, Marktheidenfeld (DE)

(72) Inventors: James Anthony Morehead, Macomb, MI (US); Matthew Bradfield, Whitehall, MI (US); Daniel Stanhope, Nunica, MI (US)

(73) Assignee: Hilite Germany GMBH (DE)

( * ) Notice: Subject to any disclaimer, the term of this patent is extended or adjusted under 35 U.S.C. 154(b) by 0 days.

(21) Appl. No.: 14/179,886

(22) Filed: Feb. 13, 2014

(65) Prior Publication Data

US 2014/0224198 A1 Aug. 14, 2014

Related U.S. Application Data

(60) Provisional application No. 61/764,894, filed on Feb. 14, 2013.

(51) Int. Cl.
*F01L 1/34* (2006.01)
*F01L 1/344* (2006.01)

(52) U.S. Cl.
CPC ..... *F01L 1/3442* (2013.01); *F01L 2001/34426* (2013.01); *F01L 2001/34463* (2013.01); *Y10T 137/7738* (2015.04)

(58) Field of Classification Search
CPC ..... F01L 1/3442; F01L 2001/34426; F01L 2001/34463; F01L 1/344; Y10T 137/7738
USPC ..... 123/90.15, 90.17
See application file for complete search history.

(56) References Cited

U.S. PATENT DOCUMENTS

| | | | | |
|---|---|---|---|---|
| 5,203,290 | A * | 4/1993 | Tsuruta | F01L 1/34406 123/90.17 |
| 5,497,738 | A | 3/1996 | Siemon et al. | |
| 5,901,674 | A | 5/1999 | Fujiwaki | |
| 6,173,687 | B1 | 1/2001 | Fukuhara et al. | |
| 6,263,846 | B1 | 7/2001 | Simpson et al. | |
| 6,378,475 | B2 | 4/2002 | Takenaka et al. | |
| 6,386,164 | B1 | 5/2002 | Mikame et al. | |
| 6,439,184 | B1 | 8/2002 | Takenaka et al. | |

(Continued)

FOREIGN PATENT DOCUMENTS

| | | |
|---|---|---|
| EP | 2 282 020 | 2/2011 |
| EP | 2397661 | 12/2011 |

(Continued)

OTHER PUBLICATIONS

International Search Report and Written Opinion which issued in connection with International Application No. PCT/EP2014/052959 on Jul. 17, 2014.

*Primary Examiner* — Zelalem Eshete
(74) *Attorney, Agent, or Firm* — Clark Hill PLC

(57) ABSTRACT

A hydraulic valve for use with a lockable cam phaser. The hydraulic valve is configured to limit the flow of pressure medium to both the advance and retard chambers, while allowing a locking pin of the cam phaser to drain. The hydraulic valve effectively limits flow during the self-centering operation of the can phaser. This is important for the system function, since it allows the phaser to select a side (i.e., the advance or retard chamber) to bleed off, reducing pressure on that side, which allows the cam phaser to move towards the mid-park (i.e., locking) position.

22 Claims, 28 Drawing Sheets

(56) References Cited

U.S. PATENT DOCUMENTS

| | | | | |
|---|---|---|---|---|
| 6,443,112 | B1 | 9/2002 | Kinugawa | |
| 6,460,496 | B2 | 10/2002 | Fukuhara et al. | |
| 6,477,996 | B2 | 11/2002 | Ogawa | |
| 6,481,402 | B1 * | 11/2002 | Simpson et al. | 123/90.17 |
| 6,668,778 | B1 | 12/2003 | Smith | |
| 6,684,835 | B2 | 2/2004 | Komazawa et al. | |
| 6,742,484 | B2 | 6/2004 | Sluka et al. | |
| 6,779,499 | B2 | 8/2004 | Takenaka et al. | |
| 6,779,500 | B2 | 8/2004 | Kanada et al. | |
| 6,820,578 | B2 | 11/2004 | Kanada et al. | |
| 6,880,505 | B2 | 4/2005 | Kinugawa et al. | |
| 6,883,481 | B2 | 4/2005 | Gardner et al. | |
| 6,945,205 | B2 | 9/2005 | Heintzen et al. | |
| 6,968,818 | B2 | 11/2005 | Plank et al. | |
| 6,976,460 | B2 | 12/2005 | Komazawa et al. | |
| 7,290,510 | B2 | 11/2007 | Takahashi et al. | |
| 7,931,000 | B2 | 4/2011 | Ushida et al. | |
| 8,033,257 | B2 | 10/2011 | Fischer | |
| 2002/0078913 | A1 | 6/2002 | Fukuhara et al. | |
| 2003/0230269 | A1 * | 12/2003 | Simpson et al. | 123/90.17 |
| 2010/0139593 | A1 * | 6/2010 | Takemura | 123/90.17 |
| 2010/0186710 | A1 | 7/2010 | Persson et al. | |
| 2010/0199937 | A1 | 8/2010 | Fujiyoshi | |
| 2010/0204900 | A1 | 8/2010 | Gelez et al. | |
| 2010/0300388 | A1 | 12/2010 | Lang et al. | |
| 2010/0313835 | A1 | 12/2010 | Yamaguchi et al. | |
| 2011/0017156 | A1 | 1/2011 | Smith | |
| 2011/0035134 | A1 | 2/2011 | Urushihata | |
| 2011/0168111 | A1 | 7/2011 | Cowgill | |
| 2011/0232594 | A1 | 9/2011 | Miyachi et al. | |
| 2011/0315104 | A1 | 12/2011 | Imamura et al. | |
| 2012/0000437 | A1 | 1/2012 | Ozawa et al. | |
| 2012/0186545 | A1 | 7/2012 | Kawamura | |

FOREIGN PATENT DOCUMENTS

| | | |
|---|---|---|
| EP | 2 412 944 | 2/2012 |
| EP | 2711511 | 3/2014 |
| JP | 2009-250073 | 10/2009 |
| JP | 2010-209780 | 9/2010 |
| JP | 2010-242531 | 10/2010 |
| JP | 2011-069287 | 4/2011 |
| JP | 2011-117317 | 6/2011 |
| JP | 2011-163270 | 8/2011 |
| JP | 2013-155612 | 8/2013 |
| WO | 2010/061936 | 6/2010 |
| WO | 2010/119322 | 10/2010 |
| WO | 2011/001702 | 1/2011 |

* cited by examiner

HYDRAULIC VALVE FOR AN INTERNAL COMBUSTION ENGINE

RELATED APPLICATION (PRIORITY CLAIM)

This application claims the benefit of U.S. provisional application Ser. No. 61/764,894, filed Feb. 14, 2013, which is hereby incorporated herein by reference in its entirety.

BACKGROUND OF THE INVENTION

The present invention relates to a hydraulic valve of an internal combustion engine, wherein the hydraulic valve is configured to limit flow during, for example, locking of a cam phaser of an internal combustion engine. More specifically, the hydraulic valve can be employed in connection with the cam phaser and locking system which is disclosed in U.S. patent application Ser. No. 13/624,196.

A typical internal combustion engine provides that a crankshaft drives a drive wheel using a chain or drive belt. A stator is joined in a torsionally rigid manner to the drive wheel. As such, the stator is drive-connected to the crankshaft by means of this drive element and drive wheel.

A corresponding rotor is engaged with the stator, and is joined to the camshaft in a torsionally rigid manner. The camshaft has cam lobes thereon which push against gas exchange valves in order to open them. By rotating the camshaft, the opening and closing time points of the gas exchange valves are shifted so that the internal combustion engine offers its optimal performance at the speed involved.

To optimize performance during operation of the internal combustion engine, the angular position of the camshaft is continuously changed relative to the drive wheel depending on the relative position of the rotor relative to the stator. Specifically, the engine RPM and the amount of torque and horsepower the engine is required to produce are the bases for the timing adjustments. These adjustments take place while the engine is in operation. This makes variable valve timing possible because intake and exhaust valve timing is constantly adjusted throughout the RPM range. The performance benefits include the increase of engine efficiency and improvement of idle smoothness. The engine can also deliver more horsepower and torque versus a similar displacement engine with conventional valve timing. This also allows the engine to have improved fuel economy and results in the engine emitting fewer hydrocarbons.

The stator includes webs which protrude radially toward a central axis of the stator. Intermediate spaces are formed between the adjacent webs, and pressure medium is introduced to these spaces via a hydraulic valve. The rotor includes vanes which protrude radially away from the central axis of the rotor, and project between adjacent webs of the stator. These vanes of the rotor subdivide the intermediate spaces between webs of the stator into two pressure chambers (often referred to as "A" and "B", respectively). In order to change the angular position between the camshaft and the drive wheel, the rotor is rotated relative to stator. For this purpose, depending on the desired direction of rotation each time, the pressure medium in every other pressure chamber ("A" or "B") is pressurized, while the other pressure chambers ("B" or "A") are relieved of pressure toward the tank.

During some operating states of the internal combustion engine, it becomes imperative to lock the position of the rotor relative to the stator. For this purpose, a valve timing control apparatus in the form of a lock pin may be utilized on the rotor for locking into a corresponding bore which is provided in the stator.

The locking pin of many cam phase locking systems provides that the locking pin is held in the unlocked position by the pressure of one chamber. If a stepped locking pin is utilized, pressure might also come from both chambers because the "step" of the stepped locking pin separates both chambers from each other.

Typical problems that occur in a cam phase locking system include, but are not limited to:

- failure to lock or inefficient locking when the pressure medium is cold;
- residual pressure in the retard and/or advance chamber (due to torque reversals of the camshaft (possibly caused by spring forces of the gas exchange valves)) tends to unlock the pin, especially when the engine-ignition is switched off but the crankshaft still rotates;
- failure to lock or inefficient locking when the engine is turned off; and
- when pressure medium gets hot sometimes it leaks, causing the pump to deliver less pressure, which influences the cam phasers as well as the operation of the lock pin, wherein there may be a failure to lock or inefficient locking due to low pressure medium pressure.

During locking of a cam phaser, it is important to limit the flow of pressure medium in order to improve the pressure differential across the phaser. On the other hand, if full flow were allowed, the system would move too quickly and become unstable. If the hydraulic resistance of the hydraulic valve were zero (i.e., unrestricted), then the pressure in both sides of the phaser would be equal to the supply pressure. In this case, there would be no force and no torque to move the phaser in either direction regardless of how much flow was drained from one side of the phaser, such as from either side of the centering slot which is disclosed in U.S. patent application Ser. No. 13/624,196.

The bottom line is that flows from a hydraulic valve must be restricted in order to generate phaser torque, and the torque is greatest when the hydraulic valve flows are matched between the two conditions of the phaser centering slot paths. The present invention provides a method of using a hydraulic valve to limit flow to a cam phaser during locking, thereby damping the system.

SUMMARY OF THE INVENTION

The present invention is directed at providing a hydraulic valve which is configured to limit the flow of pressure medium during locking of a cam phaser of an internal combustion engine, such as during locking of the cam phaser which is disclosed in U.S. patent application Ser. No. 13/624,196.

The hydraulic valve is configured to provide and receive pressure medium from the cam phaser. The hydraulic valve preferably comprises a bolt, and a spool which is controllably moveable within the bolt into a plurality of different positions. The bolt has ports, and the spool has lands. In one example embodiment of the invention, at least one of the lands of the spool is configured to limit flow of pressure medium through at least one of the ports in the bolt, whenever the spool is brought to a given position relative to the bolt, such as during locking of the cam phaser.

The hydraulic valve can be used in connection with a cam phaser which provides a centering slot which tends to naturally center and lock the rotor relative to the stator at desired times relative to the operating state of the engine. Specifically, a centering slot may be provided on the rotor and/or stator which provides a leak path for pressure medium, from both the retard and advancement chambers. This tends to center and lock the rotor relative to the stator. As such, a fail-safe locking mechanism is provided in the event of an interruption in the control signal (i.e., zero duty cycle or current applied to the actuator).

The present invention provides for efficient locking when the engine is turned off, even when the pressure medium is cold, or when pressure medium pressure is reduced.

Additional advantages of the invention may be derived from the patent claims, the description and the drawings.

BRIEF DESCRIPTION OF THE DRAWINGS

The present invention will hereinafter be described in conjunction with the appended drawing figures, wherein like reference numerals denote like elements, wherein:

FIGS. 15-33 are provided to effectively disclose the hydraulic valve itself, wherein:

FIG. 1 is a perspective view of a rotor component of a valve timing control device;

FIG. 2 is a front view of a stator component of the valve timing control device;

FIG. 3 shows the rotor and stator engaged with each other;

FIG. 4 is a cross-sectional view taken along line 4-4 of FIG. 3, showing a pressure medium control valve component of the valve timing control device, as well as a camshaft and a simplified hydraulic valve;

FIGS. 5-8 show the pressure medium control valve in various states, during various stages of operation of the engine;

FIG. 9 shows an orientation of the rotor relative to the stator during which point in time a centering slot is blocked off;

FIGS. 10 and 11 shows orientations of the rotor relative to the stator during which point in time the centering slot is accessible;

FIG. 12 shows an alternative rotor having a larger slot (i.e., fluid path);

FIG. 13 shows an alternative stator having a larger slot (i.e., fluid path);

FIG. 14 shows the stator of FIG. 13 being used with the rotor of FIG. 1;

FIGS. 15-19 show various positions or states of a hydraulic valve, where the hydraulic valve is in accordance with an embodiment of the present invention;

FIG. 20 is a side view of a bolt component of the hydraulic valve shown in FIGS. 15-19;

FIG. 21 is a cross-sectional view of the bolt shown in FIG. 20, taken along line 21-21 of FIG. 20;

FIG. 22 is a side view of a spool component of the hydraulic valve shown in FIGS. 15-19;

FIG. 23 is a cross-sectional view of the spool shown in FIG. 22, taken along line 23-23 of FIG. 22;

FIG. 24 is a state diagram which illustrates the direction of fluid flow during four main positions or states of the hydraulic valve shown in FIGS. 15-19;

FIG. 25 provides labels for the different ports of the hydraulic valve;

FIGS. 26-29 are partial cross-sectional views of the hydraulic valve shown in FIGS. 15-19, showing fluid flow during the four main positions of states of the hydraulic valve;

FIGS. 30-34 provide schematic diagrams which illustrate the different states of the phaser and lock pin (i.e., valve timing control device), during the main positions or states of the hydraulic valve;

DETAILED DESCRIPTION

Figure 1:
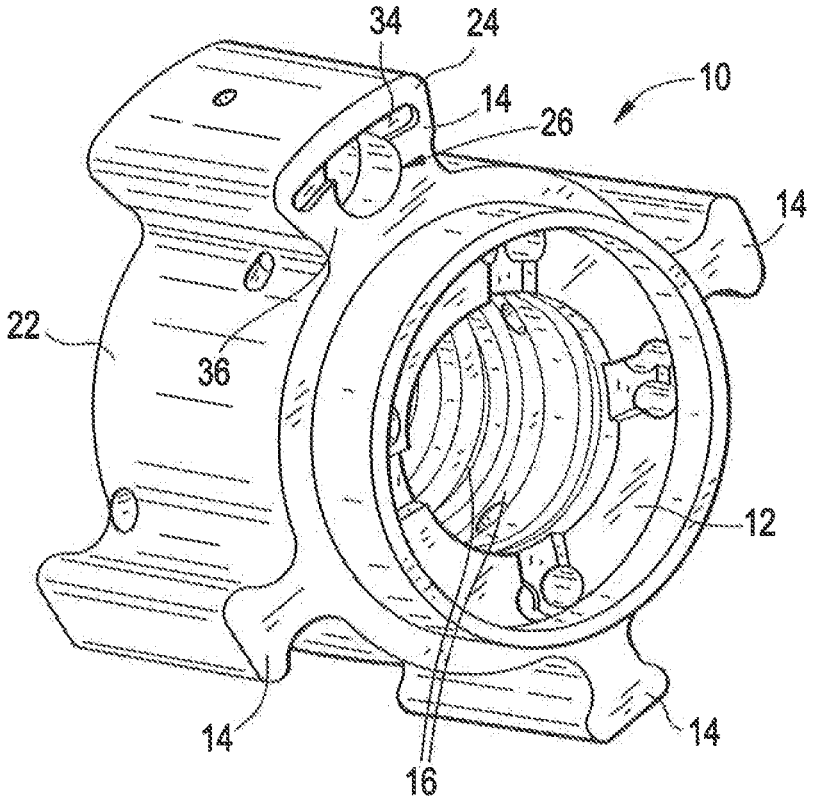
FIGS. 1-14 are provided to effectively disclose a cam phaser and valve timing control device with which a hydraulic valve which is in accordance with an embodiment of the present invention can be used.

While this invention may be susceptible to embodiment in different forms, there are shown in the drawings and will be described herein in detail, specific embodiments with the understanding that the present disclosure is to be considered an exemplification of the principles of the invention, and is not intended to limit the invention to that as illustrated.

An embodiment of the present invention provides a hydraulic valve which is configured for use with a valve timing control device, in effect a cam phaser, of an internal combustion engine. More specifically, the hydraulic valve can be used in connection with the cam phaser which is disclosed in U.S. patent application Ser. No. 13/624,196, which will now be described.

As shown in FIG. 1, one of the components of the valve timing control device comprises a rotor 10. The rotor 10 includes a hub 12, as well as vanes 14 which protrude radially away from the hub 12. The rotor 10 also includes annular channels 16 which communicate with additional channels 18, 20 (see FIG. 3) which lead to the outside surface 22 of the rotor 10. As will be described, these channels 16, 18, 20 provide fluid paths for pressure medium.

The rotor 10 also includes, in one (24) of its vanes 14, a pressure medium control valve chamber 26. As shown in FIGS. 4-8, a pressure medium control valve 28 is disposed in this chamber 26, and the rotor 10 provides at least one internal fluid channel 30 which leads to this chamber 26 and which communicates with at least one of the annular channels 16 provided in the hub 12 of the rotor 10. As such, pressure medium can flow back and forth between the pressure medium control valve 28 and a hydraulic valve 32 (shown in FIG. 4).

As shown in FIG. 1, proximate the pressure medium control valve chamber 26, and in fluid communication therewith, is a centering opening such as a slot 34 formed on the external surface 36 of the vane 24 of the rotor 10. As will be described more fully later herein, this centering slot 34 works to provide that pressure medium can move along the centering slot 34 to the pressure medium control valve 28 when the rotor 10 is in certain positions relative to the stator 10, during certain stages of operation of the engine.

Preferably, the rotor 10 has no sealing on its outside. Instead, preferably sealing is effected by the length of the vanes (i.e., sealing length). Preferably, there is no sealing because if a slot had to be provided for a seal on the radial outside of the vane, this would reduce the available space for the pressure medium control valve chamber 26. That being said, sealing can be provided while still staying very much within the scope of the present invention.

Figure 2:
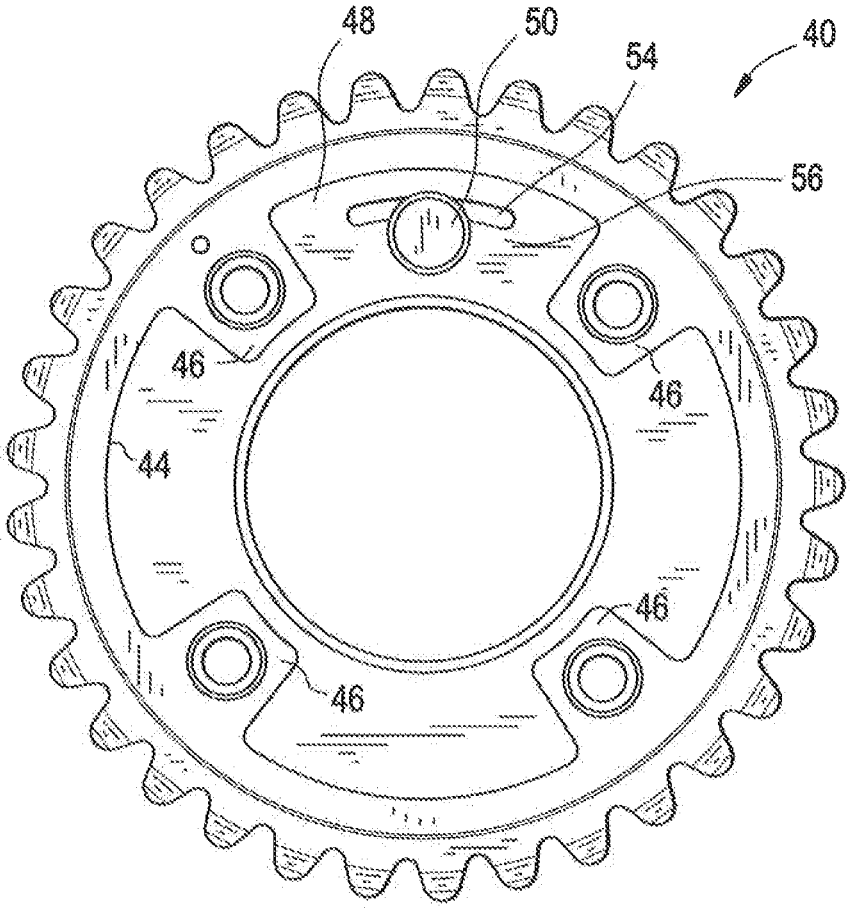
Figure 3:
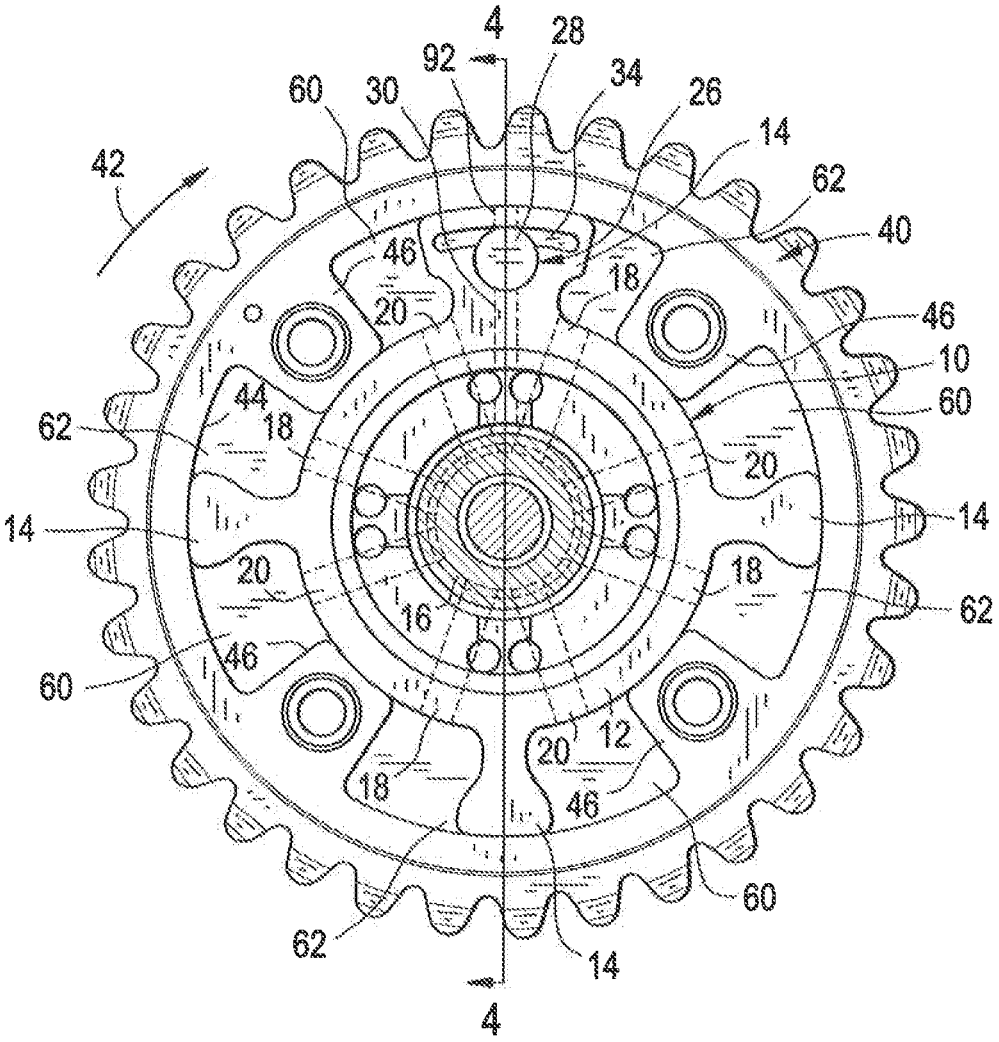
Figure 36:
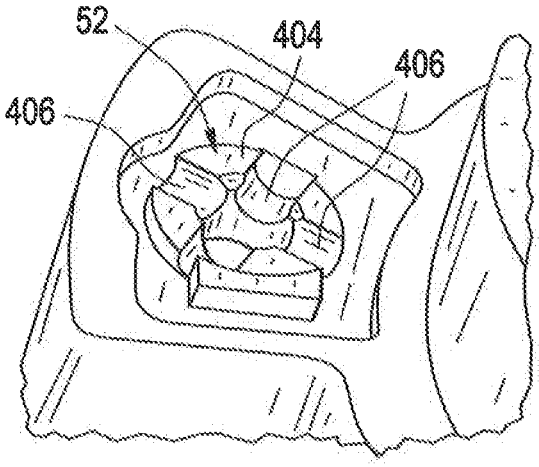
FIG. 36 shows the case where an end face of the lock pin includes cross channels or notches.

As shown in FIG. 2, another component of the valve timing control device comprises a stator 40. The stator 40 is drive-connected to a crankshaft (not shown) by means of a drive element (also not shown). This is represented in FIG. 3 using arrow 42. The stator 40 comprises a cylindrical stator base 44, and webs 46 protrude from the base 44, radially toward the inside. The webs 46 are spaced apart, and in one of these spaces 48, between two of the webs 46, is a lock pin bore 50 configured to receive a lock pin 52 (shown in FIGS. 4-8) of the pressure medium control valve 28, thereby locking the position of the rotor 10 relative to the stator 40 (see FIGS. 4, 5 and 8). As shown in FIG. 36, an end face 404 of the lock pin 52 could be provided as having one or more cross-channels 406 or notches formed therein, and to that end the lock pin 52 can be formed of a material such as tin to facilitate machining said one or more cross-channels or notches 406.

As shown in FIG. 2, preferably a centering slot 54 is also formed in an external surface 56 of the stator 40, proximate the lock pin bore 50. As will be described more fully later herein, this centering slot 54 works to provide that pressure medium can move along the centering slot 54 in the stator 10, to the centering slot 34 on the rotor 10, and to the pressure medium control valve chamber 26, when the rotor 10 is in certain positions relative to the stator 40, during certain stages of operation of the engine.

Either one or both of the rotor 10 and stator 40 may be sintered, during which time the slots 34, 54 become formed. While FIGS. 1 and 2 depict a centering slot 34, 54 being provided on each of the rotor 10 and the stator 40, it is possible while still staying well within the scope of the present invention to provide a centering slot on only one of these components, such as the stator 40, and/or to provide fluid channels which look completely different from the centering slots 34, 54 which are depicted herein, so long as some form of fluid path is provided from the pressure chambers 60, 62 existing between the vanes 14 and webs 46, to the pressure medium control valve chamber 26.

Additionally, while the term "centering" is used herein, it must be appreciated that the lock pin bore 50 need not be (and most likely would not he) provided exactly between two adjacent webs 46 of the stator 10; however, it is preferred that the lock pin bore 50 be provided at some intermediate position between the fully retarded and fully advanced positions of the rotor 10.

FIG. 3 shows the rotor 10 engaged with the stator 40. Specifically, the rotor 10 and stator 40 are engaged with each other such that the centering slots 34, 54 face each other (i.e., the external surface 36 of the rotor 10 faces the exterior surface 56 of the stator 40. As shown in FIG. 3, the rotor 10 and stator 40 are coaxial relative to each other, and each of the vanes 14 of the rotor 10 is disposed between two adjacent webs 46 of the stator 10. As such, pressure chambers 60, 62 are provided between each vane 14 and web 46. The rotor 10 provides at least one fluid path to each pressure chamber 60, 62, such that pressure medium can flow back and forth between each pressure chamber 60, 62 and a hydraulic valve 32 (see FIG. 4). More specifically, the internal channels 16, 18, 20 of the rotor 10 are configured such that there are two sets of pressure chambers 60, 62 disposed between the vanes 14 of the rotor 10 and the webs 46 of the stator 40, wherein every other chamber 60 is an advance channel, and the remaining pressure chambers 62 are retard pressure channels. During operation, providing more pressure medium pressure in the advancement chambers 60 than the retard chambers 62 causes the rotor 10 to move clockwise relative to the stator 40. In this case, pressure medium from the compressed retard chambers 62 will be drained to the tank T (as indicated by arrows 70 in FIG. 4). On the other hand, providing more pressure medium pressure in the retard chambers 62 than the advancement chambers 60 causes the rotor 10 to move counter-clockwise relative to the stator 40. In this case, pressure medium from the compressed advancement chambers 60 will be drained to the tank T (as indicated by arrows 70 in FIG. 4). It should be noted that the conventions of advance/retard and/or clockwise/counter-clockwise and/or A and B could be reversed and remain within the scope of the present invention.

Figure 4:
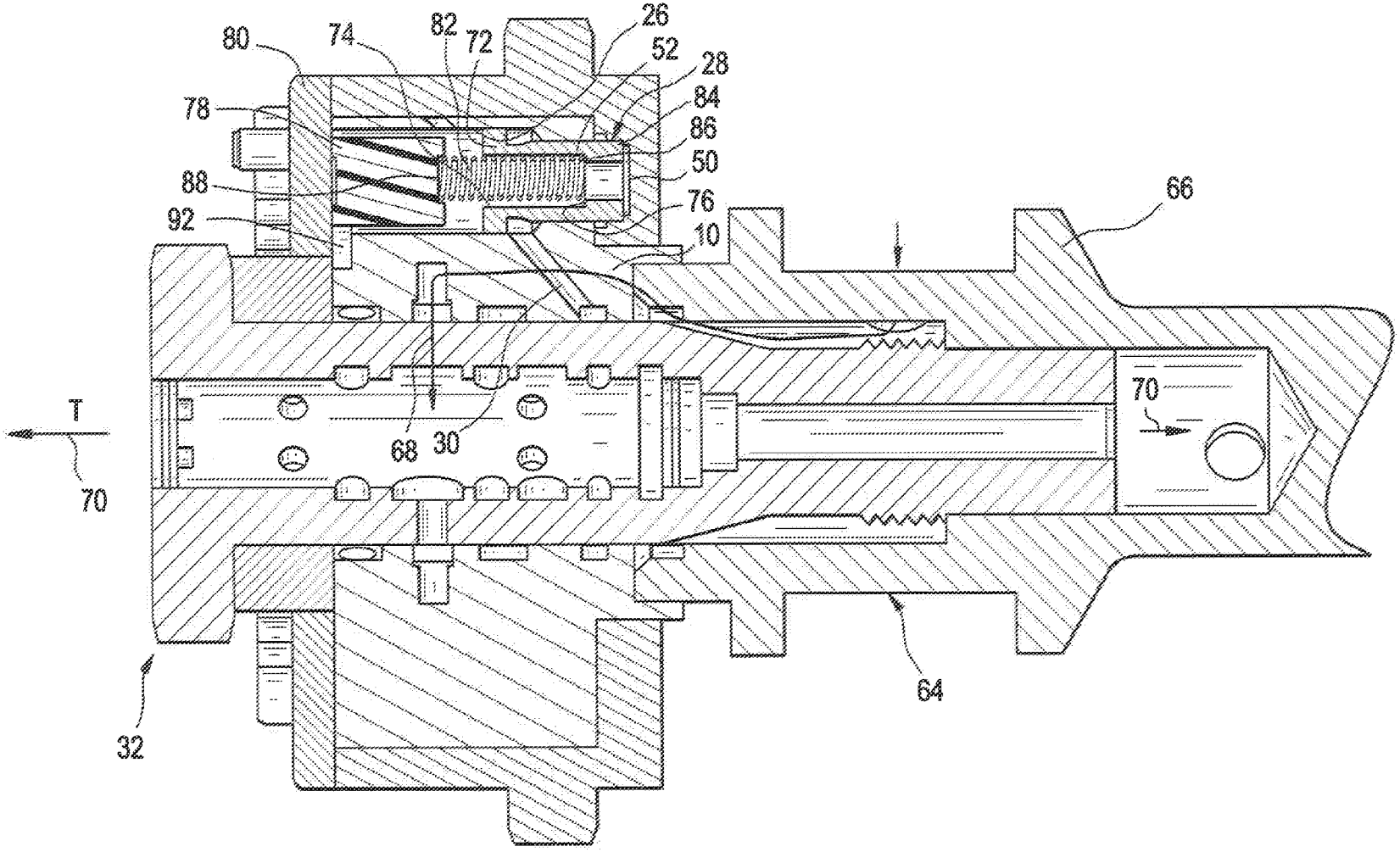

FIG. 4 is a cross-sectional view taken along line 4-4 of FIG. 3. As shown, the rotor 10 is joined to a camshaft 64 in a torsionally rigid manner. The camshaft 64 includes one or more cam lobes (not shown) which are configured to push against gas exchange valves (not shown) in order to open them. A hydraulic valve 32 is disposed within the camshaft 64, proximate the rotor 10. The hydraulic valve 32 which is shown in FIG. 4 is conventional and, therefore, is shown just generally in the form of a single piece. The hydraulic valve 32 is controlled via electronics and an electric actuator to effectively provide for the controlled flow of pressure medium, in order to control the camshaft 64. More specifically, a pump (not shown) works to supply pressure medium to the hydraulic valve (as indicated by arrow 68 in FIG. 4), and the hydraulic valve drains to the tank T.

An embodiment of the present invention provides a hydraulic valve which is configured to limit flow during locking of the cam phaser in a centered position (i.e., locking of the pressure medium control valve 28), and this inventive hydraulic valve will be described in detail later herein in connection with FIGS. 15-36.

The pressure medium control valve 28 will now be described in more detail with reference to FIG. 4. As shown, the pressure medium control valve 28 includes a lock pin 52. Preferably, the lock pin 52 is generally cylindrical, is generally non-stepped, but has a head 72. The lock pin 52 also includes a throughbore 74 having an internal shoulder 76. As will be described more fully later herein, the throughbore provides that pressure medium can flow through the lock pin 52.

The pressure medium control valve 28 also includes a cap 78 which abuts a cover 80 which is fixed to the stator 40, as well as a biasing member, such as a compression spring 82, which is configured to engage the lock pin 52 and push the lock pin 52 into engagement with the lock pin bore 50 in the stator 40 (see FIGS. 4, 5 and 8), such that the position of the rotor 10 become effectively locked with regard to the stator 40. Preferably, the portion 84 of the lock pin 52 which engages in the lock pin bore 50 has a cylindrical outer surface as opposed to being tapered; however, a tapered lock pin can be used while still staying well within the scope of the present invention. Regardless, while one end 86 of the compression spring 82 engages the internal shoulder 76 of the lock pin 52, the other end 88 of the compression spring 82 engages the cap 78. While the end 86 of the compression spring 82 is shown as engaging an internal shoulder 76 in the lock pin 52, this end 86 of the compression spring 82 may engage a rear surface of the lock pin 52, with the other end 88 of the compression spring 82 engaging in a recess provided in the cap 78. The compression spring 82 can be implemented in many ways while still staying very much within the scope of the present invention. In fact, while the biasing member is depicted in FIGS. 4-8 as being a compression spring 82, the biasing member may take other forms so long as the lock pin 52 is urged toward the lock pin bore 50 which is provided in the stator 40.

As shown in FIGS. 4-8, the rotor 10 provides at least one fluid channel 30 which leads to the pressure medium control valve chamber 26. As such, pressure medium can flow back and forth between the hydraulic valve 32 (see FIG. 4) and the pressure medium control valve chamber 26, through the rotor 10, along at least one of the annular channels 16. Additionally, the rotor 10 provides at least one additional channel 92 which is configured to provide that pressure medium can vent from the pressure medium control valve chamber 26 to the crankcase. Also, the flow from the hydraulic valve 32 leads to tank T which is established by the crankcase. At times, as will be described in more detail hereinbelow, the pressure medium pushes on the head 72 of the lock pin 52 in order to overcome the force of the compression spring 82, such that the lock pin 52 withdraws and unseats from the lock pin bore 50, thereby freeing the rotor 10 from the stator 40 such that the rotor 10 can pivot relative to the stator 40.

The operation of the pressure medium control valve 28 and the flow of pressure medium during certain stages of operation of the engine will now be described with reference to FIGS. 5-11.

Figure 5:
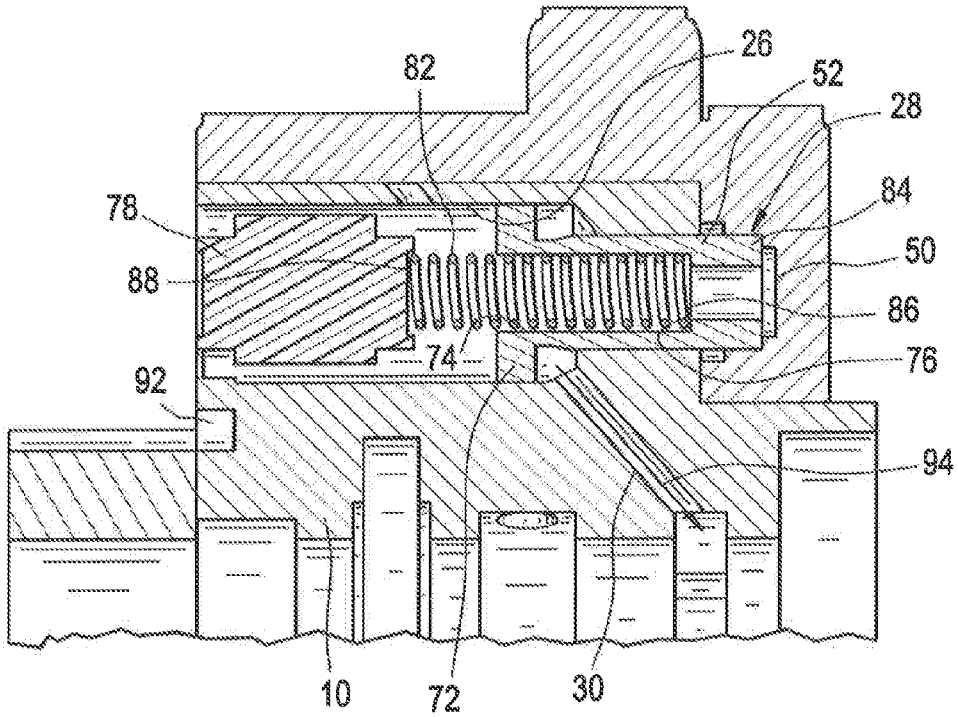
Figure 9:
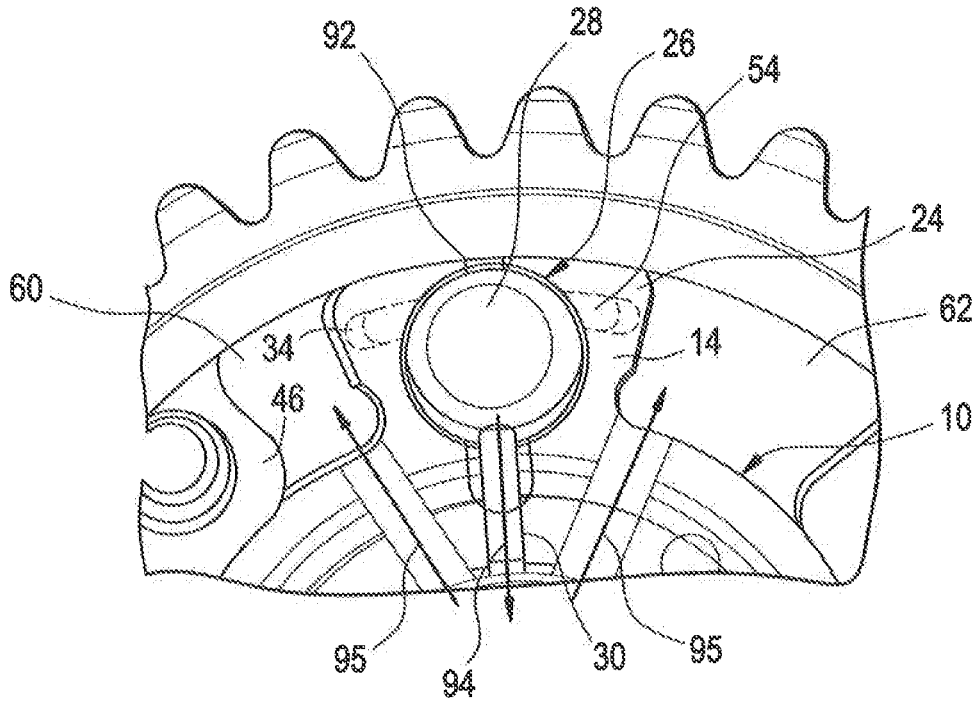

FIG. 5 shows the state of the pressure medium control valve 28 before unlocking during engine start or any time the phase position has been locked. As shown, the pressure medium control valve 28 is at a deactivated position, during which time the compression spring 82 pushes the lock pin 52 into engagement with the lock pin bore 50 of the stator 10. At this time, pressure medium can vent from the pressure medium control valve chamber 26 (as indicated by arrow 94 in both FIGS. 5 and 9), to the hydraulic valve 32 (see FIG. 4). Additionally, as shown in FIG. 9, pressure medium throttles to both the advancement and retard chambers 60, 62 (i.e., to both sides of each vane 14) (as indicated by arrows 95 in FIG. 9), while the centering slot 54 on the stator 40 is dosed off to the pressure chambers 60, 62 as a result of the position of the rotor 10 being such that the vane 24 of the rotor 10 covers the centering slot 54 on the stator 40.

Figure 6:
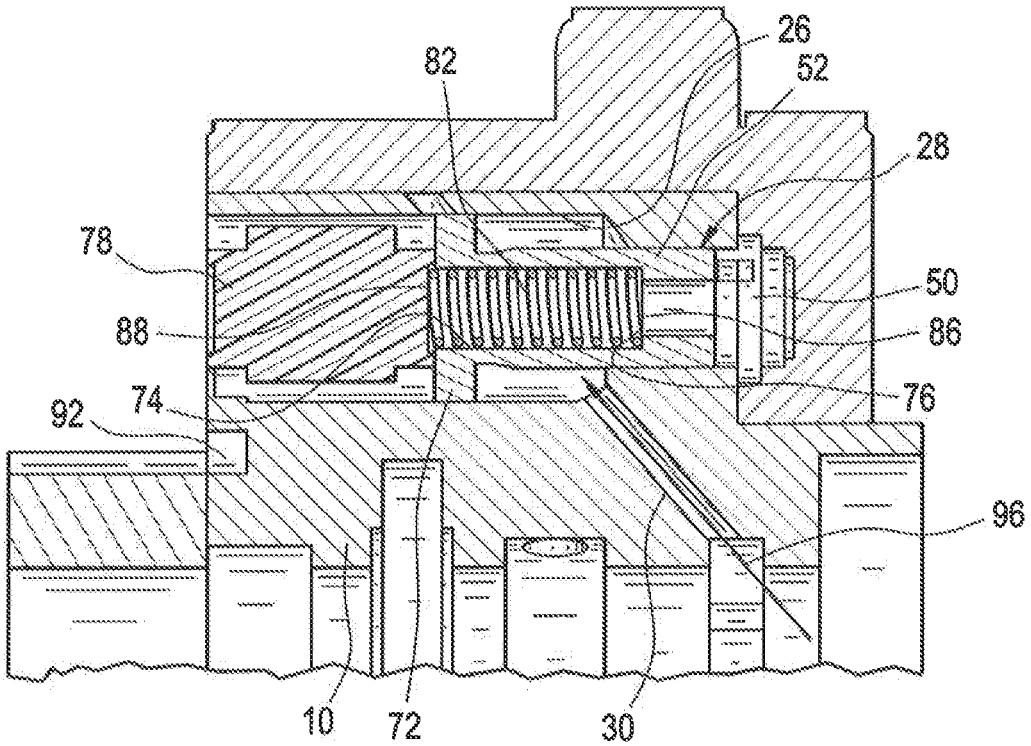

FIG. 6 shows the state of the pressure medium control valve 28 unlocked while the engine is running. As shown, pressure medium is provided to the pressure medium control valve chamber 26 (as indicated by arrow 96), from the hydraulic valve 32 (see FIG. 4) such that the biasing force of the compression spring 82 is overcome, and the lock pin 52 is pushed out of engagement with the lock pin bore 50 in the stator 40. The lock pin 52 is moved into seated contact with the cap 78, which provides that pressure medium cannot vent through the rotor 10 (i.e., through channel(s) 92 to the crankcase). During this time, the rotor 10 becomes effectively unlocked from the stator 40 and is free to pivot relative to the stator 40, as shown in FIG. 10.

Figure 7:
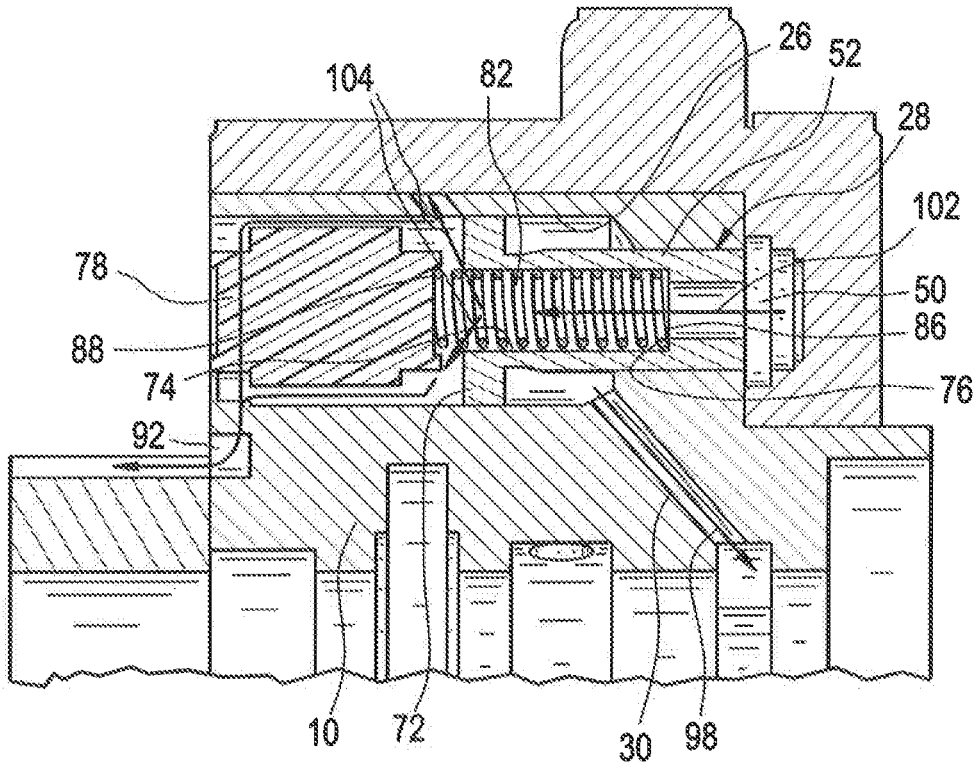

FIG. 7 shows the state of the pressure medium control valve 28 during phaser locking, which is generally required during engine shutdown but can also occur any time a locked phase position is desired. As shown, during engine shutdown, the pressure medium control valve 28 moves toward its deactivated position. Pressure medium vents from the pressure medium control valve chamber 26 through channel 30 in the rotor 10 (as indicated by arrow 98), to the hydraulic valve 32 (see FIG. 4), and the compression spring 82 tends to push the lock pin 52 causing the lock pin 52 to unseat from the cap 78, thereby opening a leak path. As shown in FIGS. 10 and 11, as the rotor 10 pivots relative to the stator 40, not only does pressure medium throttle to the pressure chambers 60 or 62 (as indicated by arrows 100 in FIG. 11), but the centering slot 54 in the stator 40 becomes accessible to the pressure medium in the pressure chambers 60 or 62. This creates a low pressure area that drives the rotor 10 to a position such that the lock pin 52 becomes aligned with the lock pin bore 50. As the rotor 10 is moving such that the lock pin 52 ultimately becomes aligned with the lock pin bore 50, the pressure medium in the pressure chambers 60 or 62 can vent along the centering slot 54 provided in the stator 40 (as indicated by arrow 101 in FIGS. 10 and 11), along the centering slot 34 provided in the rotor 10, to the pressure medium control valve chamber 26 (as indicated by arrow 102 in FIG. 7), through the throughbore 74 in the lock pin 52, past the cap 78 (as indicated by arrows 104), out the channel(s) 92 provided in the rotor 10, to the crankcase.

Figure 8:
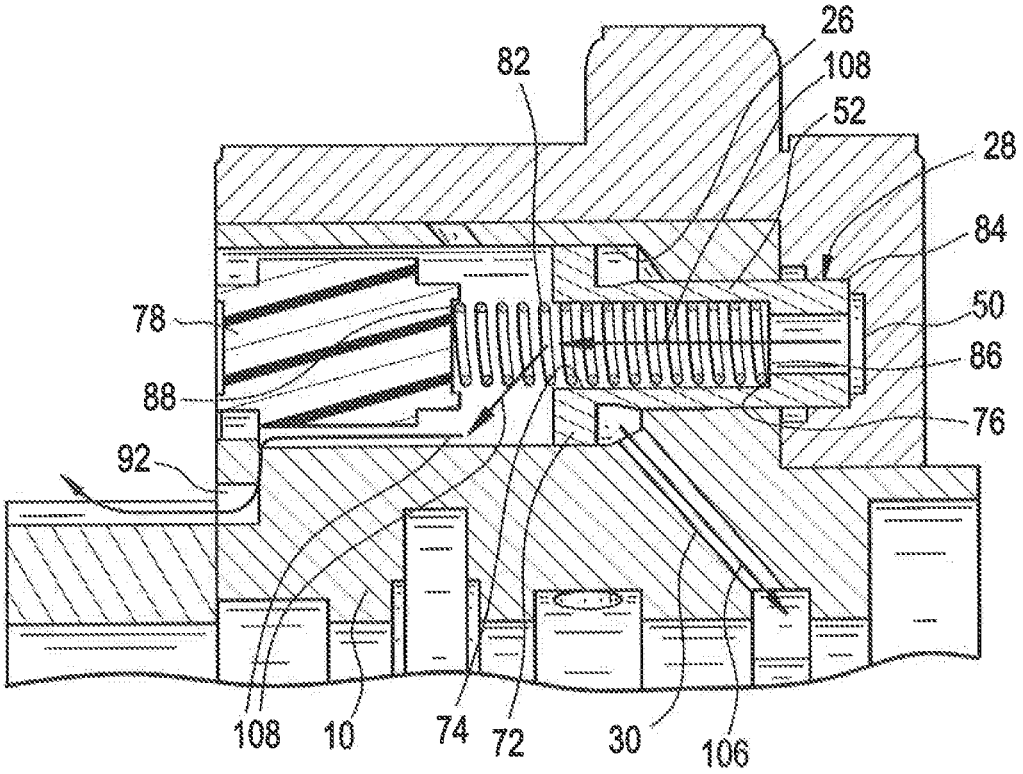

As shown in FIG. 8, at some point after engine shutdown, the lock pin 52 becomes aligned with the lock pin bore 50 and seats therein. During this time, any pressure medium remaining in the pressure medium control valve chamber 26 can vent through the channels 30, 92 in the rotor 10 (both to the hydraulic valve 32 (said fluid flow being indicated by arrow 106 in FIG. 8 and by arrow 94 in FIG. 9) and to the crankcase (said fluid flow being indicated by arrow 108 in FIG. 8)). At this time, as shown in FIG. 9, the rotor 10 is positioned relative to the stator 40 such that the centering slot 54 in the stator 40 is covered by the position of the rotor 10. As such, the pressure chambers 60, 62 cannot vent through the centering slots 34, 54, and pressure medium throttles to the pressure chambers 60, 62 (as indicated by arrows 95 in FIG. 9).

Figure 10:
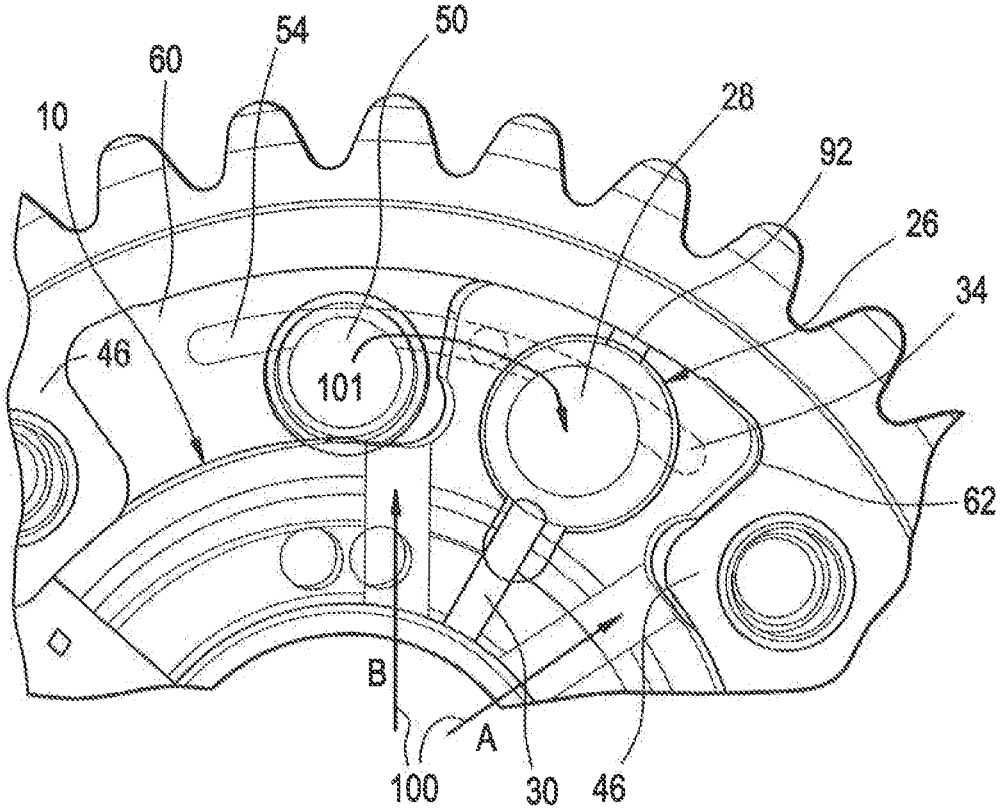
Figure 11:
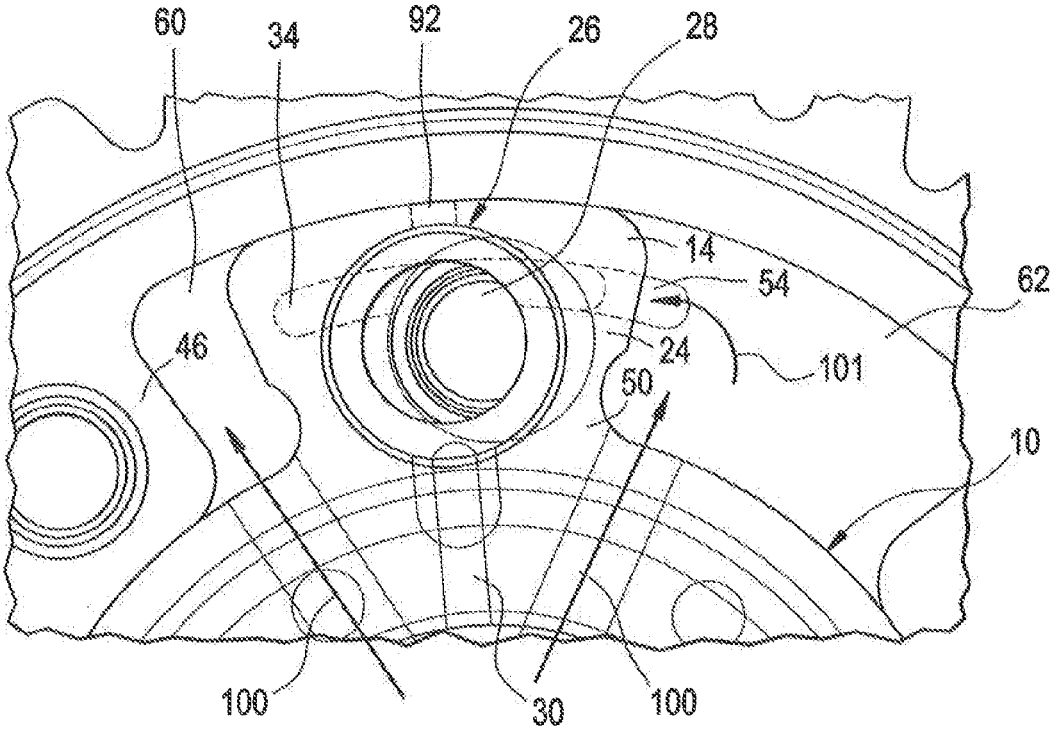

While the centering slots 34, 54 are inaccessible to the pressure chambers 60, 62 when the position of the rotor 10 is locked relative to the stator 40 via the lock pin 52 (or when the lock pin 52 is at least generally aligned with the lock pin bore 50), as shown in FIG. 10 preferably the centering slots 34, 54 on the rotor 10 and stator 40 are configured such that they are in fluid communication with each other when the rotor 10 is at either the partially to fully advanced or retarded position.

Figure 12:
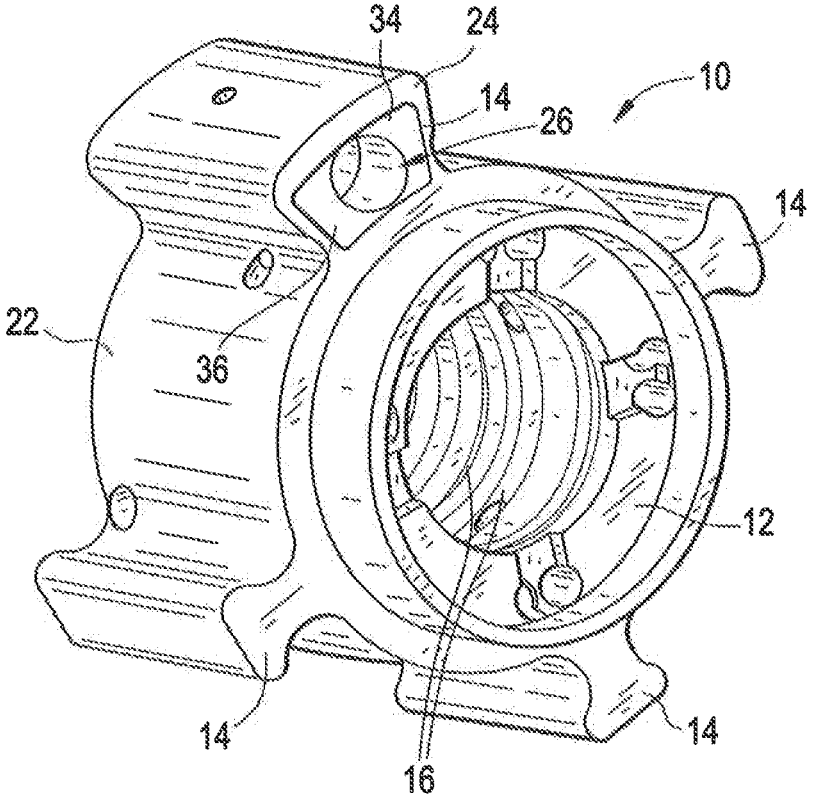
Figure 13:
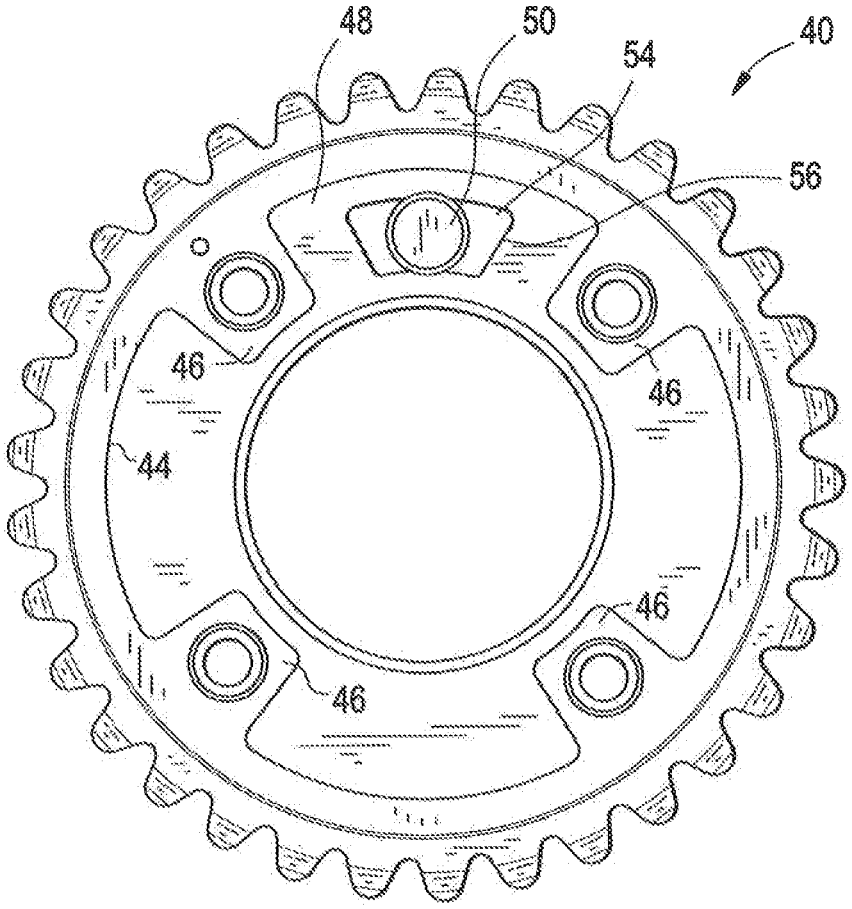
Figure 14:
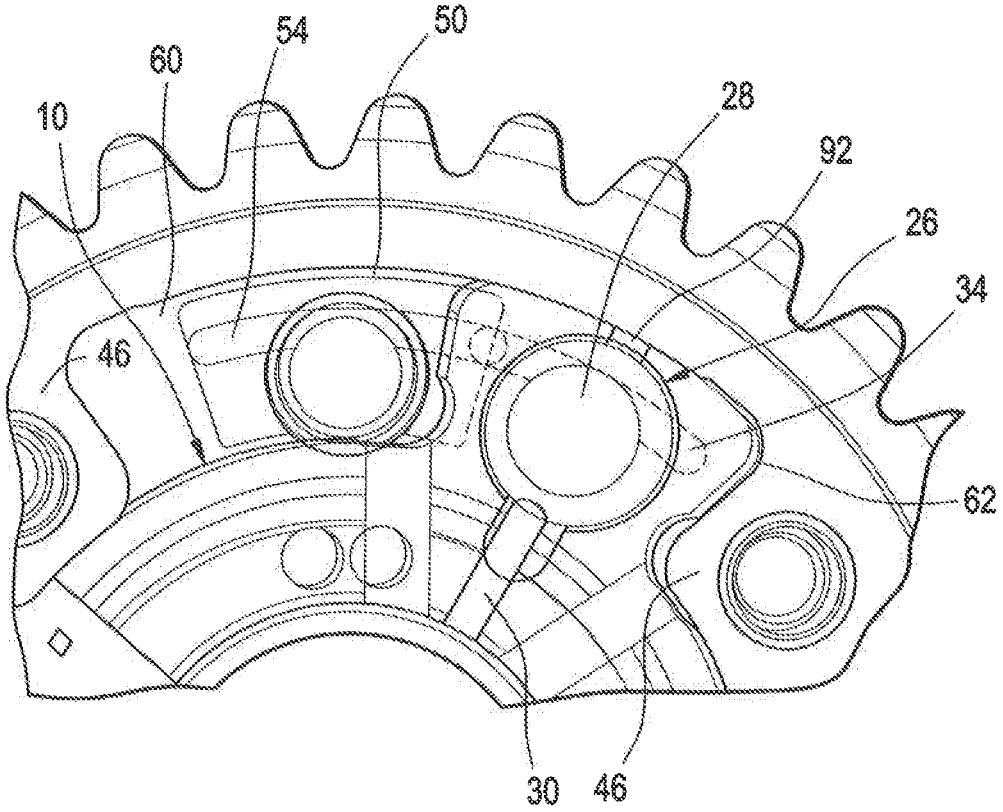

The slots 34, 54 on the rotor 10 and stator 40 are depicted in FIGS. 1 and 2 as being relatively narrow, generally linear recesses provided on the external surfaces 36,56 of the rotor 10 and stator 40, these fluid paths can take many other forms. For example, FIG. 12 shows where the slot 34 is provided as being much bigger on the rotor 10, while FIG. 13 shows where the slot 54 is provided as being much bigger on the stator 40. FIG. 14 shows an example where a large slot 34 is provided on the stator 40, but a smaller slot 54 is provided on the rotor 10. As discussed, the fluid path leading away from the pressure chambers 60, 62 can take many forms.

Providing a mechanism which tends, during certain operation states of the engine, to cause the rotor 10 to move to a position such that lock pin 52 becomes aligned with the lock pin bore 50 in the stator 40, provides several benefits. Additional benefits are provided as a result of the lock pin 52 being part of a pressure medium control valve 28 through which pressure medium can vent from the pressure chambers 60, 62, during certain stages of engine operation. Many of these benefits have been discussed hereinabove.

Benefits can also be provided by employing an embodiment of the present invention in the form of a hydraulic valve which is configured to limit flow during locking of a cam phaser (i.e., such as during locking of the pressure medium control valve 28 described hereinabove). This inventive hydraulic valve will now be described in detail.

Figure 15:
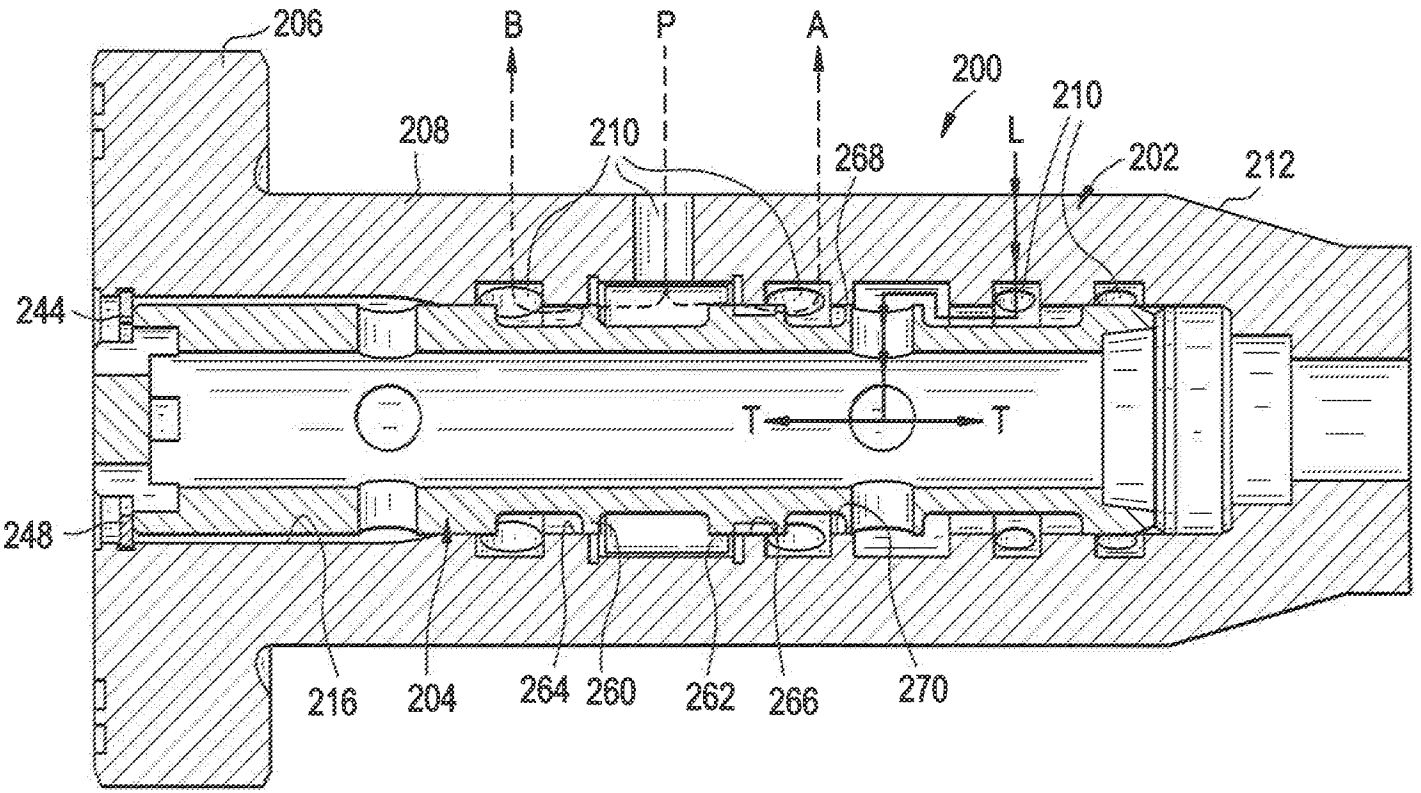
Figure 25:
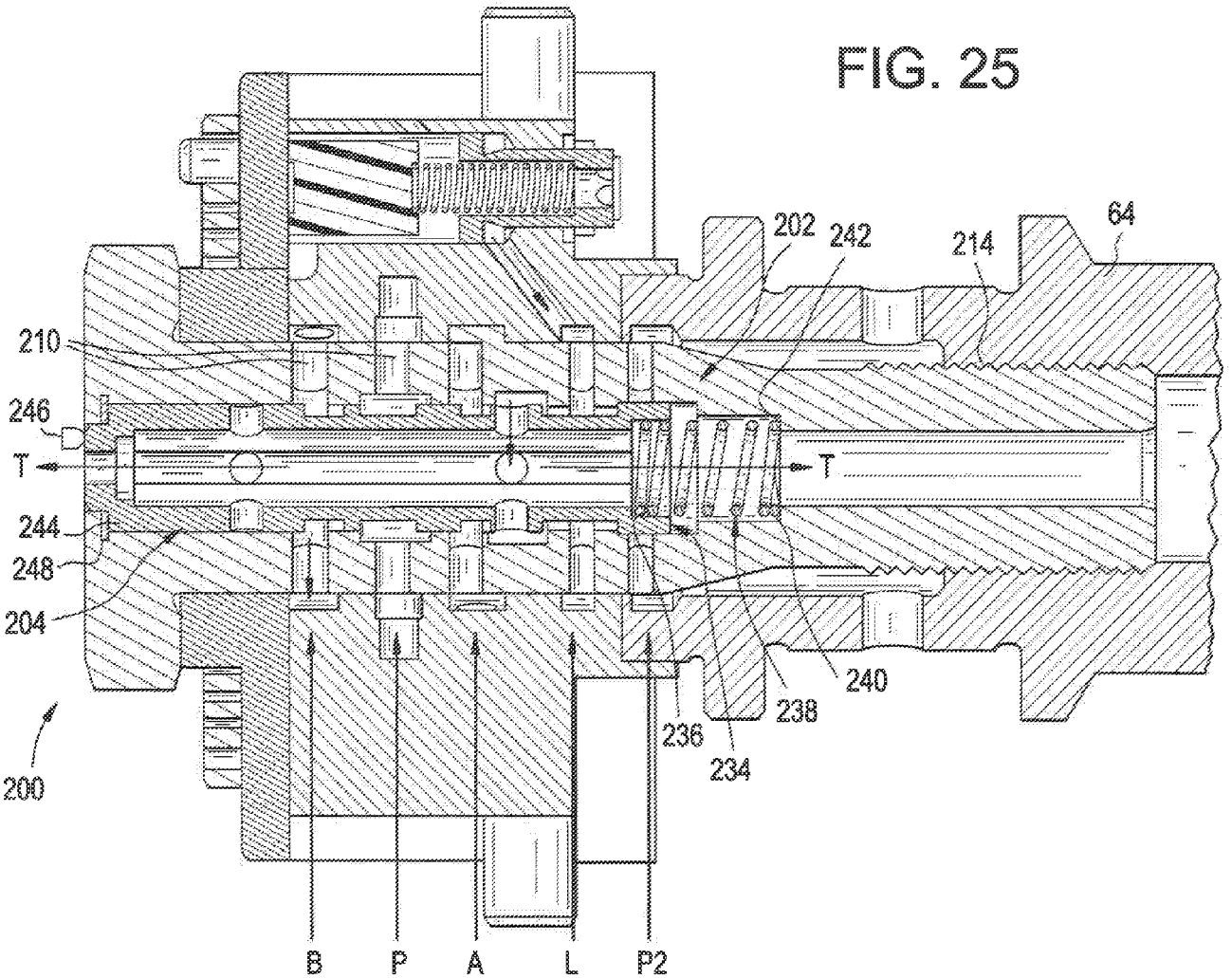

As shown in FIG. 15, the hydraulic valve 200 comprises a first member such as bolt 202, and a second member such as a spool 204 which is disposed in the bolt 202. The bolt 202 is shown isolated in FIGS. 21 and 22. As shown, the bolt 202 preferably has a head portion 206, a generally cylindrical portion 208 which has ports or holes 210 formed thereon, a tapered portion 212, and a threaded portion 214. As shown in FIG. 25, the threaded portion 214 of the bolt 202 is configured to threadably engage the camshaft 64. The bolt 202 has a throughbore 216 in which is disposed the spool 204 (as shown in FIGS. 15-19 and 25), and in addition to having ports 210, the bolt 202 has internal projections 220, as well as internal recesses 222 which provide fluid passageways for pressure medium.

Figure 22:
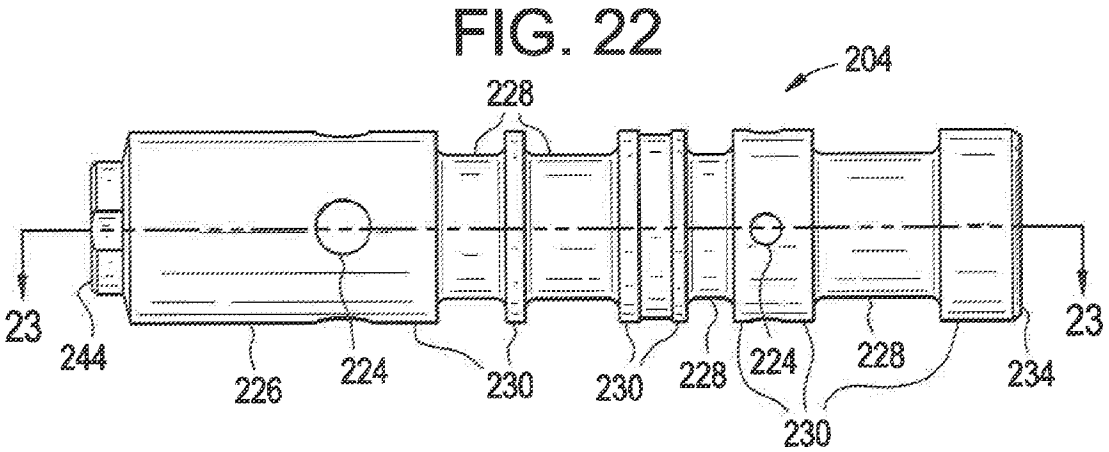
Figure 23:
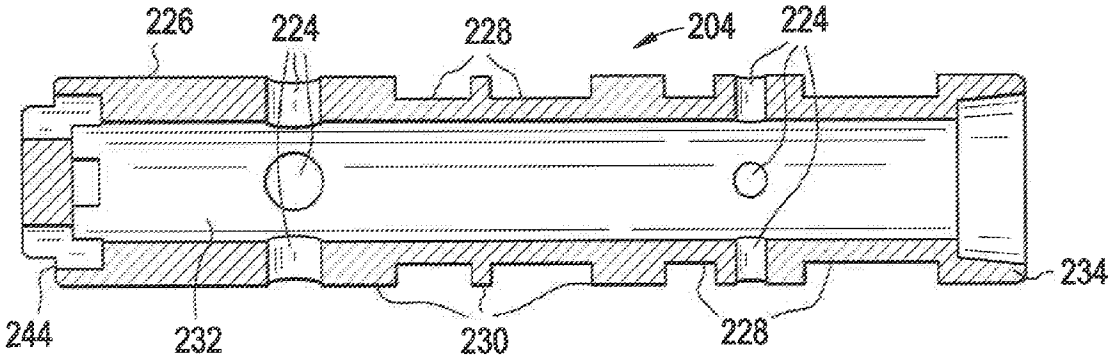

The spool 204 is shown isolated in FIGS. 22 and 23. As shown, the spool 204 is preferably generally cylindrical, and has a plurality of ports or holes 224 formed therein. The exterior surface 226 of the spool 204 provides a plurality of reduced diameter portions 228, as well as a plurality of lands 230, which (as will be described more fully later herein) function to control the flow of pressure medium. The spool 204 also includes a throughbore 232. As will be described in more detail later, at certain times while the hydraulic valve 200 is operating, pressure medium flows out either end of the throughbore 232 of the spool 204 to Tank ("T").

As shown in FIG. 25, one end 234 of the spool 204 is configured to engage one end 236 of a compression spring 238, while the other end 240 of the compression spring 238 engages an internal shoulder 242 of the bolt 202. The other end 244 of the spool 204 is configured to be engaged by a tappet 246 of an electromagnetic actuator, which effectively controls the position of the spool 204 relative to the bolt 202. More specifically, the spool 204 is shiftable within the bolt 202 to align given lands 230, ports 224 and reduced diameter portions 228 of the spool 204 with certain internal projections 220, ports 210 and internal recesses 222 of the bolt 202, to control the flow of pressure medium. A snap ring 248 is preferably provided on the bolt 202, proximate the end 244 of the spool 204 with which the tappet 246 engages, and the bolt 202 has an internal shoulder 250, such that the spool 204 is effectively captive within the bolt 202, between the snap ring 248 and the internal shoulder 250 of the bolt 202.

FIG. 25 identifies, using letters, all of the different ports or fluid passageways provided by the hydraulic valve. Specifically, the "A" port provides for fluid flow to and from the retard or "A" chambers of the cam phaser (i.e., pressure chambers 62 as shown in, for example, FIG. 3), the "B" port provides for fluid flow to and from the advance or "B" chambers of the cam phaser (i.e., pressure chambers 60 as shown in, for example, FIG. 3), the "L" port provides for fluid flow from the lock pin 52 from fluid passageways 30 and 92 (see FIG. 7) of the pressure medium control valve 28), the "P" and "P2" ports provide for fluid flow from the supply pressure (i.e., "Pump"), and the Tank ports ("T") provide for fluid flow into the spool 204 and out either end 234, 244 of the spool 204 to Tank.

As mentioned, an electromagnetic actuator is used to control the position of the spool 204 relative to the bolt 202. More specifically, the actuator shifts the spool 204 within the bolt 202 to align given lands 230, ports 224 and reduced diameter portions 228 of the spool 204 with certain projections 220, ports 210 and internal recesses 222 of the bolt 202, to control the flow of pressure medium.

Figure 24:
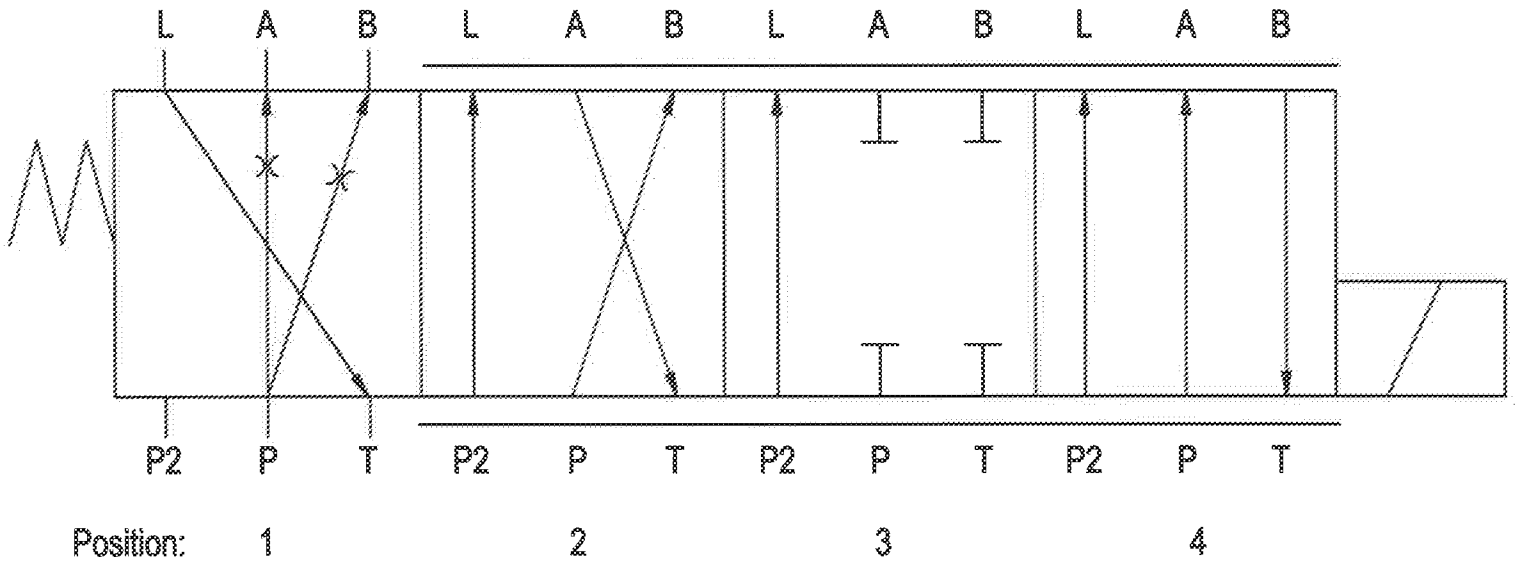

The different positions and states of the hydraulic valve 200 will now be described. In the following description, the word "fluid" is used to mean pressure medium, such as oil. Also, in the following description, many Figures are referenced. Among the Figures which are referenced, FIGS. 15-19 show the various main positions of the spool 204 relative to the bolt 202 (i.e., the main states of the hydraulic cylinder 200); FIG. 24 is a state diagram which illustrates the direction of fluid flow during four main states (i.e., position 1, 2, 3 and 4) of the hydraulic valve 200; FIGS. 26-29 are partial cross-sectional views which show, at different times, fluid flow along the different ports of the hydraulic valve 200; and FIGS. 30-34 provide schematic diagrams which illustrate the different states of the cam phaser (i.e., rotor 10, stator 40, etc.) and lock pin 52, during the main positions or states of the hydraulic valve 200.

Figure 26:
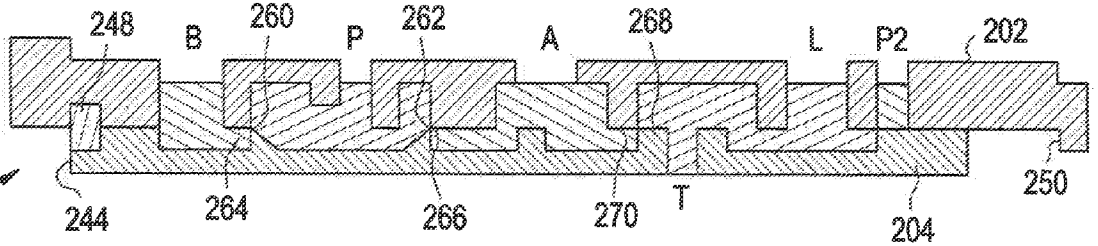
Figure 30:
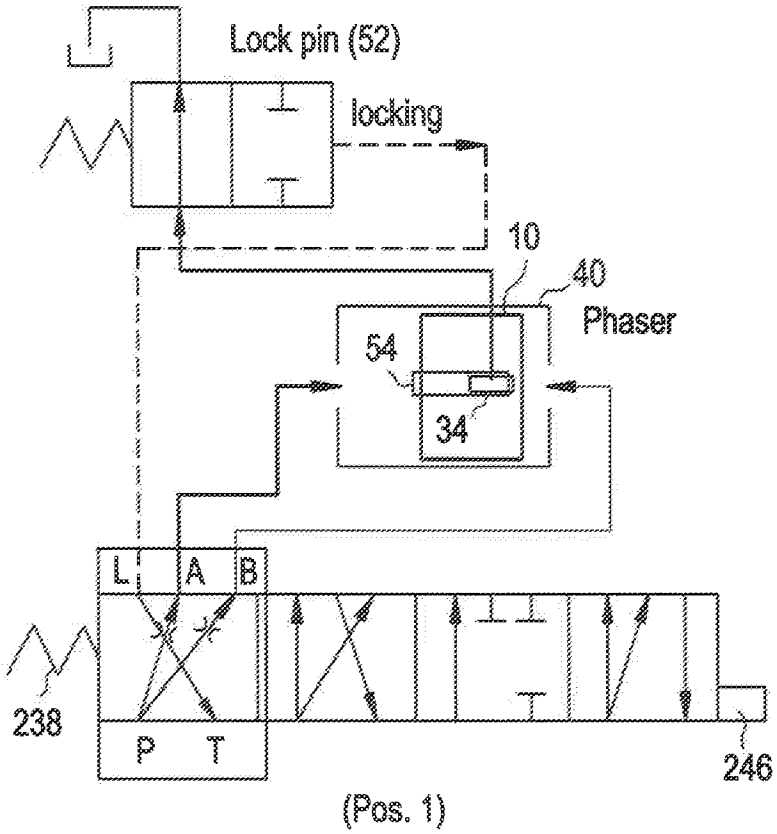

When the hydraulic valve 200 is in the position shown in FIG. 15, the spool 204 is preferably bottomed out in one direction, in contact with the snap ring 248. Regardless, a fluid path is open between the chamber beneath the head of the lock pin 52 and the tank ("T"), allowing the lock pin 52 to move toward the lock pin bore 50 under the force of the return spring 82. This also opens the fluid path between the centering slot (i.e., 34, 54) and the tank, as shown in FIG. 7. The fluid flow during this state is generally depicted in FIG. 24 as position 1, and is depicted in FIGS. 26 and 30. As shown, when the hydraulic valve 200 is in this position, fluid is allowed to vent from the lock pin 52 ("L") to Tank ("T"), but the hydraulic valve 200 limits fluid flow from Pump ("P") to the advance ("B") and retard ("A") chambers of the cam phaser (i.e., to chambers 60 and 62). Fluid flow from Pump ("P") to both the A and B chambers of the cam phaser is limited due to lands 260, 262 of the spool 204 being sized, shaped, configured and positioned relative to corresponding internal projections 264, 266 of the bolt 202, such that fluid cannot easily and quickly flow past the interface. Furthermore, fluid flow from the retard chamber (chamber "B") of the cam phaser to tank ("T") is prevented due to land 268 of the spool 204 being sized, shaped, configured and positioned relative to a corresponding internal projection 270 of the bolt 202, such that fluid cannot flow past the interface.

When the hydraulic valve 200 is in the position shown in FIG. 15 and the rotor 10 is advanced relative to the locking position as shown in FIG. 10, a fluid path is effectively open between the advance chamber 60 (chamber "B") of the cam phaser and Tank ("T") (via the lock pin 52), reducing the pressure in the chamber. A restricted amount of pressurized pressure medium is provided to both sides of the cam phaser, but only the retard chamber (chamber "A") remains fully pressurized. This creates a pressure differential across the rotor 10 that forces it to move counter-clockwise towards the locking position.

When the hydraulic valve 200 is in the position shown in FIG. 15 and the rotor 10 is retarded relative to the locking position as shown in FIG. 11, a fluid path is effectively open between the retard chamber 62 (chamber "A") of the cam phaser and Tank ("T") (via the 1 pin 52). A restricted amount of pressurized pressure medium is provided to both sides of the cam phaser, but only the advance chamber 60 (chamber "B") remains fully pressurized. This creates a pressure differential across the rotor 10 that forces it to move clockwise towards the locking position.

As such, when the hydraulic valve 200 is in the position shown in FIG. 15, regardless of the position of the rotor 10 relative to the stator 40, the rotor 10 tends to move to the locking position. When the hydraulic valve 200 is in the position shown in FIG. 15 and the lock pin 52 has finally engaged with the lock pin bore 50 as shown in FIG. 8, fluid is trapped inside the advance and retard chambers and no relative motion between the rotor 10 and stator 40 can occur.

Figure 16:
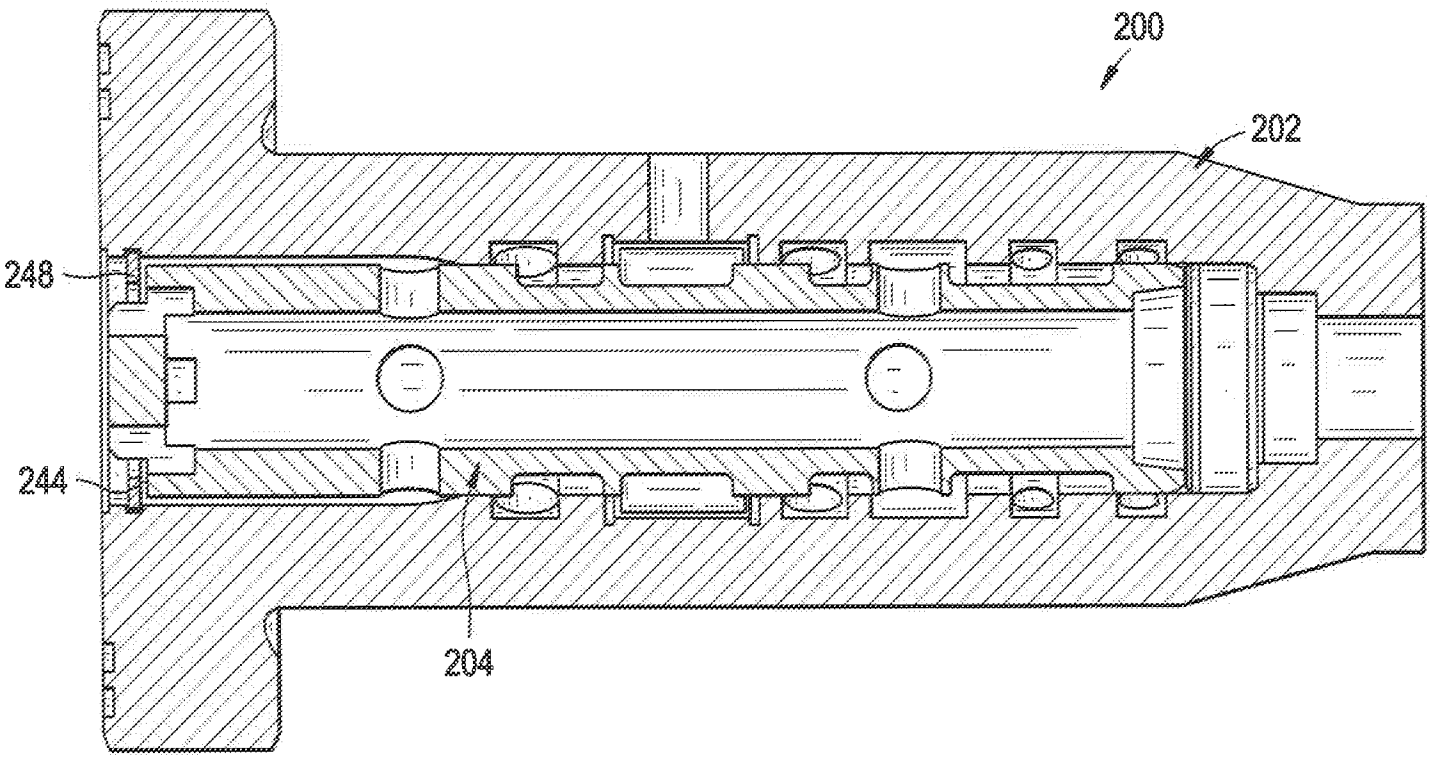

When the hydraulic valve 200 is in the position shown in FIG. 16, the spool 204 is advanced such that there is a certain level of space (such as 0.40 mm) provided between the end 244 of the spool 204 and the snap ring 248. Regardless, a fluid path is opened farther between the supply pressure port (Pump or "P") and the advance chamber (chamber "B"). If the lock pin 52 is engaged with the lock pin bore 50 as shown in FIG. 8, then the advance chamber (chamber "B") can be pre-filled, but the rotor 10 will not move relative to the stator 40. On the other hand, if the lock pin 52 is not engaged with the lock pin bore 50, then the rotor 10 will tend to advance relative to the stator 40.

Figure 17:
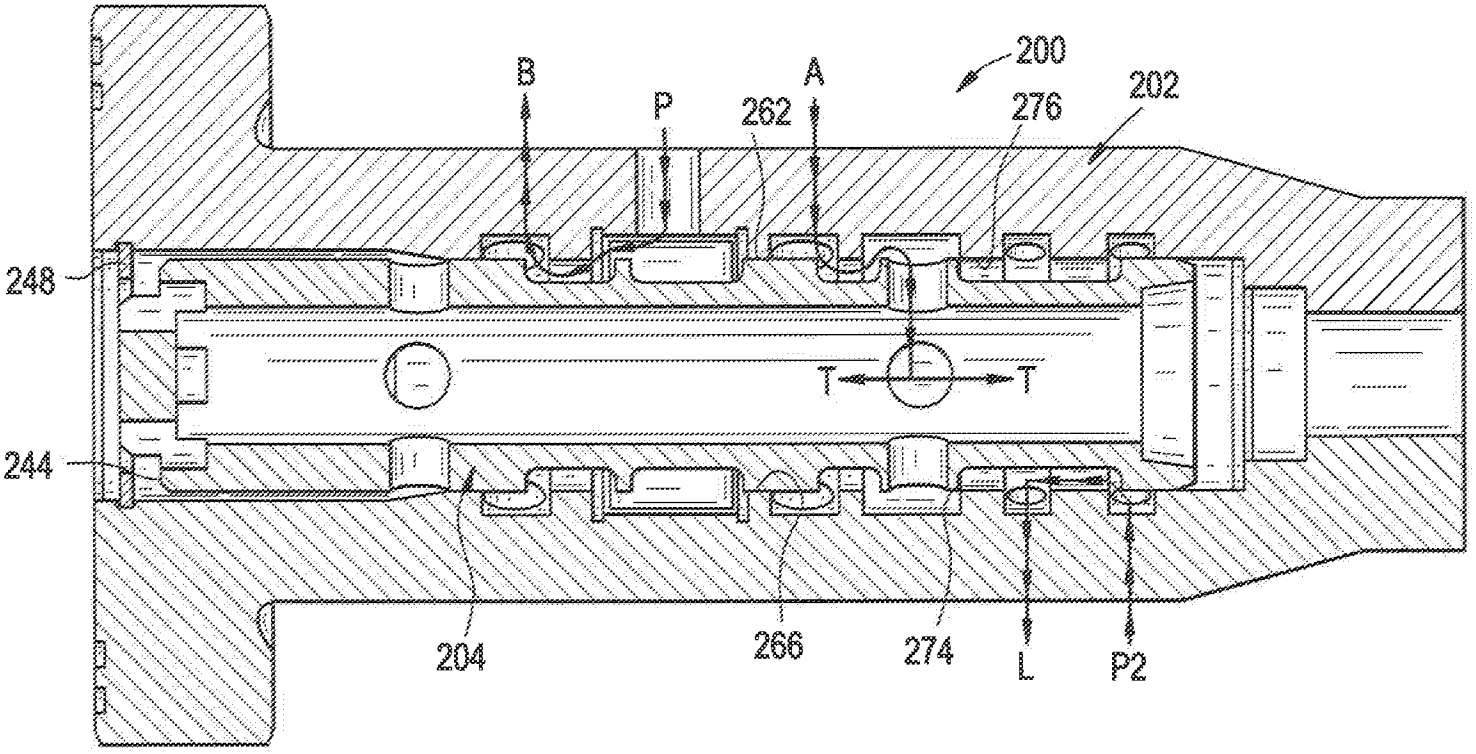
Figure 27:
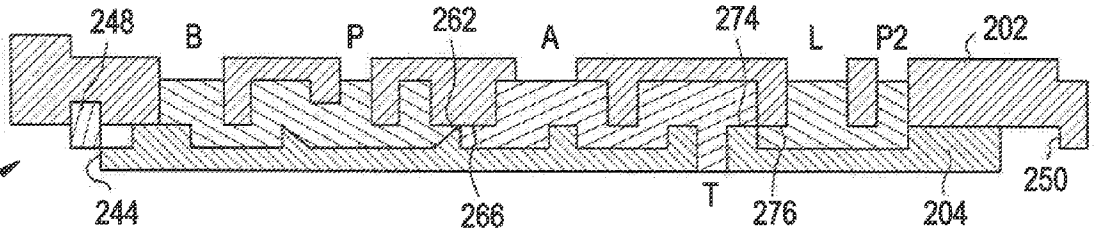
Figure 32:
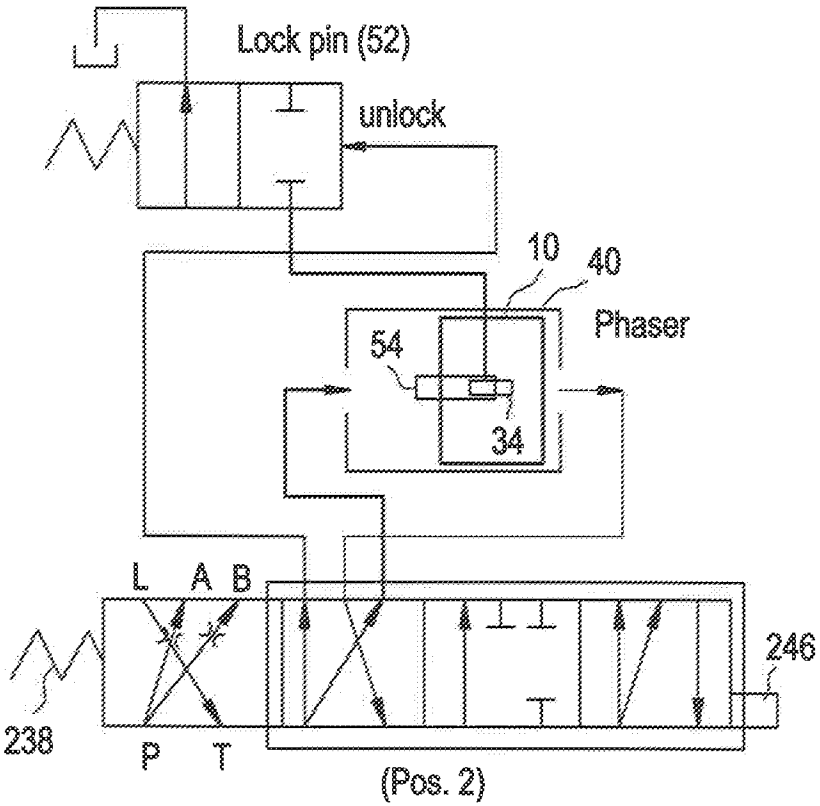

When the hydraulic valve is in the position shown in FIG. 17, the spool 204 is further advanced such that there is more space (such as 1.30 mm) provided between the end 244 of the spool 204 and the snap ring 248. Regardless, a fluid path is open between the supply pressure (Pump or "P") and the advance chamber (chamber "B") of the phaser. A fluid path is also open between the supply pressure (Pump or "P2") and the lock pin 52 ("L"). This results in the lock pin 52 lifting out of the lock pin bore 50, and sealing the pressure medium control valve 28 of the centering slot mechanism as shown in FIG. 6. This combination results in the rotor 10 moving to advance relative to the stator 40. The fluid flow during this state is generally depicted in FIG. 24 as position 2, and is depicted in FIGS. 27 and 32. As shown, when the hydraulic valve 200 is in this position, fluid vents from the retard chamber (chamber "A") of the phaser to Tank ("T"), while the advance chamber (chamber "B") of the phaser (and the lock pin 52 ("L")) remains pressurized. Fluid flow from Pump ("P") to the retard chamber (chamber "A") of the cam phaser is prevented due to land 262 of the spool 204 being sized, shaped, configured and positioned relative to corresponding internal projection 266 of the bolt 202, such that fluid cannot flow past the interface. Furthermore, fluid flow from the lock pin 52 ("L") to Tank ("T") is prevented due to land 274 of the spool 204 being sized, shaped, configured and positioned relative to a corresponding internal projection 276 of the bolt 202, such that fluid cannot flow past the interface.

Figure 18:
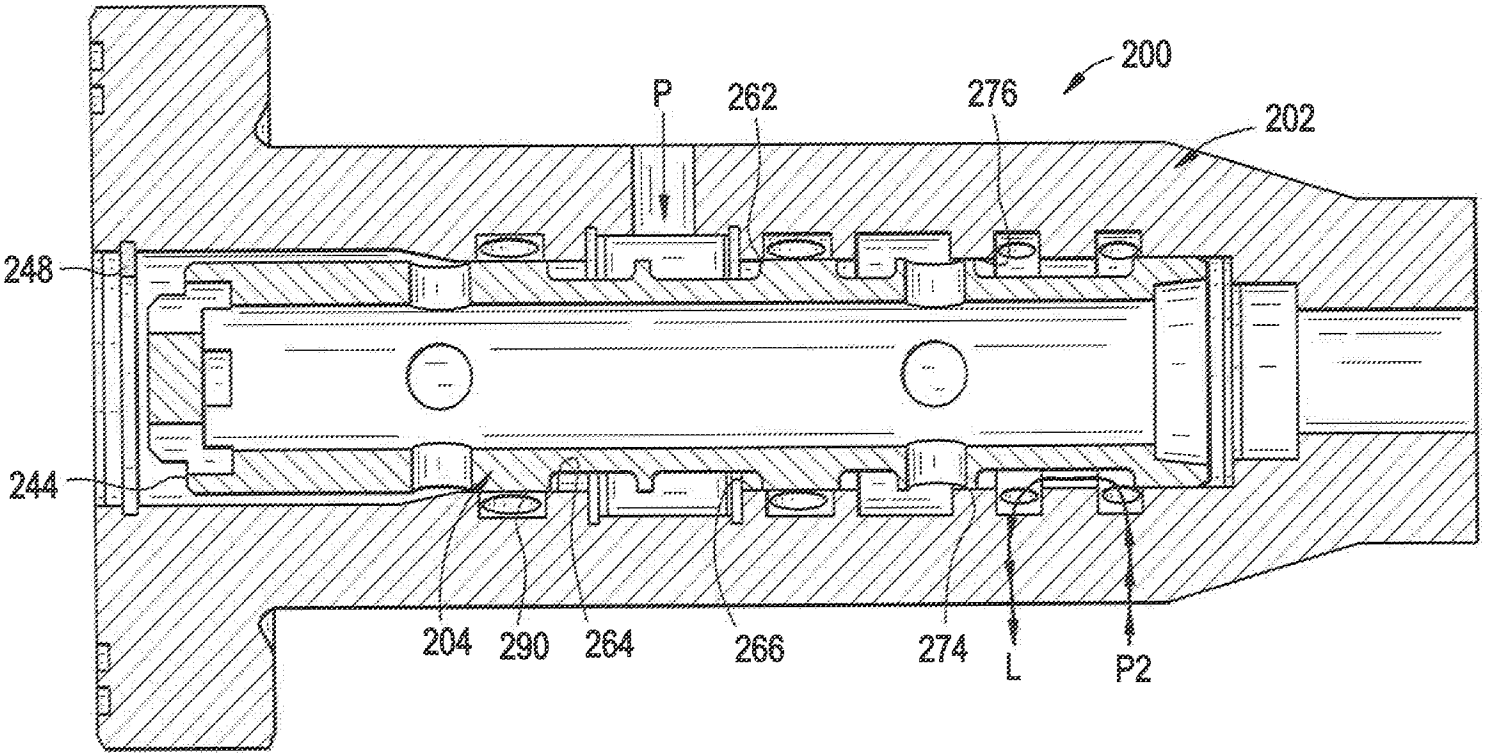
Figure 28:
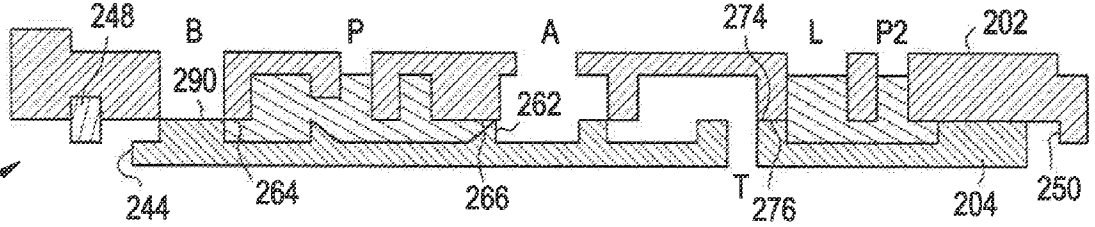
Figure 33:
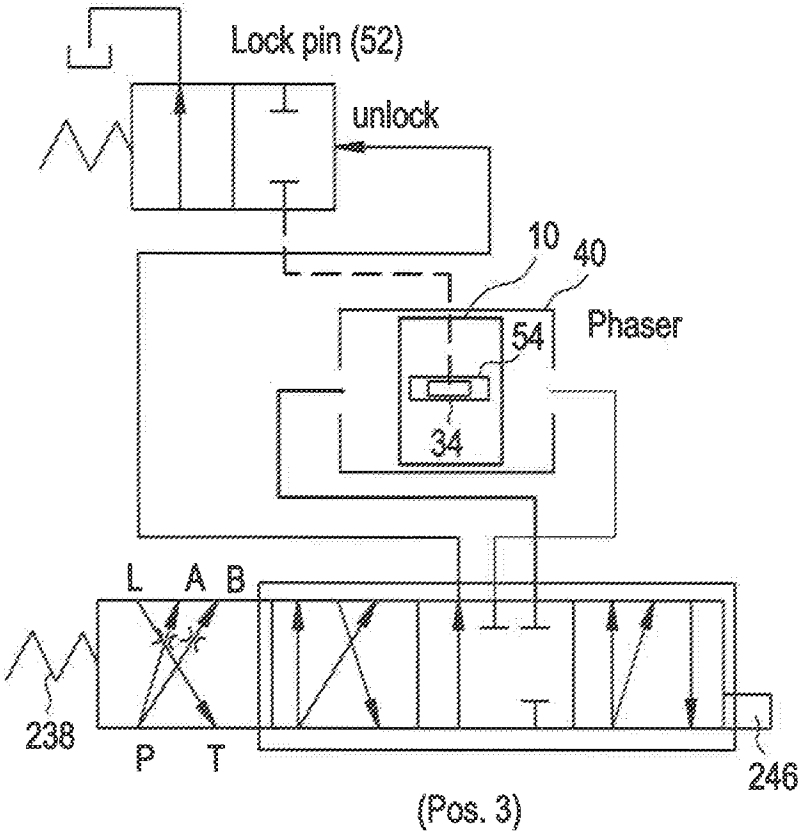

When the hydraulic valve 200 is in the position shown in FIG. 18, the spool 204 is further advanced such that there is more space (such as 2.50 mm) provided between the end 244 of the spool 204 and the snap ring 248. Regardless, fluid is trapped in the advance and retard chambers (chambers "A" and "B", respectively) of the cam phaser, and the fluid path remains open between the supply pressure (Pump or "P2") and the chamber beneath the lock pin 52 ("L"). This position is used to hold the camshaft 64 in a fixed position relative to the crankshaft. The fluid flow during this state is generally depicted in FIG. 24 as position 3, and is depicted in FIGS. 28 and 33. Fluid flow from Pump ("P") to either the retard ("A") or advance ("B") chambers of the cam phaser is prevented due to lands 290, 262 of the spool 204 being sized, shaped, configured and positioned relative to corresponding internal projections 264, 266 of the bolt 202, such that fluid cannot flow past the interface. Furthermore, fluid flow from the lock pin 52 ("L") to Tank ("T") is prevented due to land 274 of the spool 204 being sized, shaped, configured and positioned relative to a corresponding internal projection 276 of the bolt 202, such that fluid cannot flow past the interface.

Figure 19:
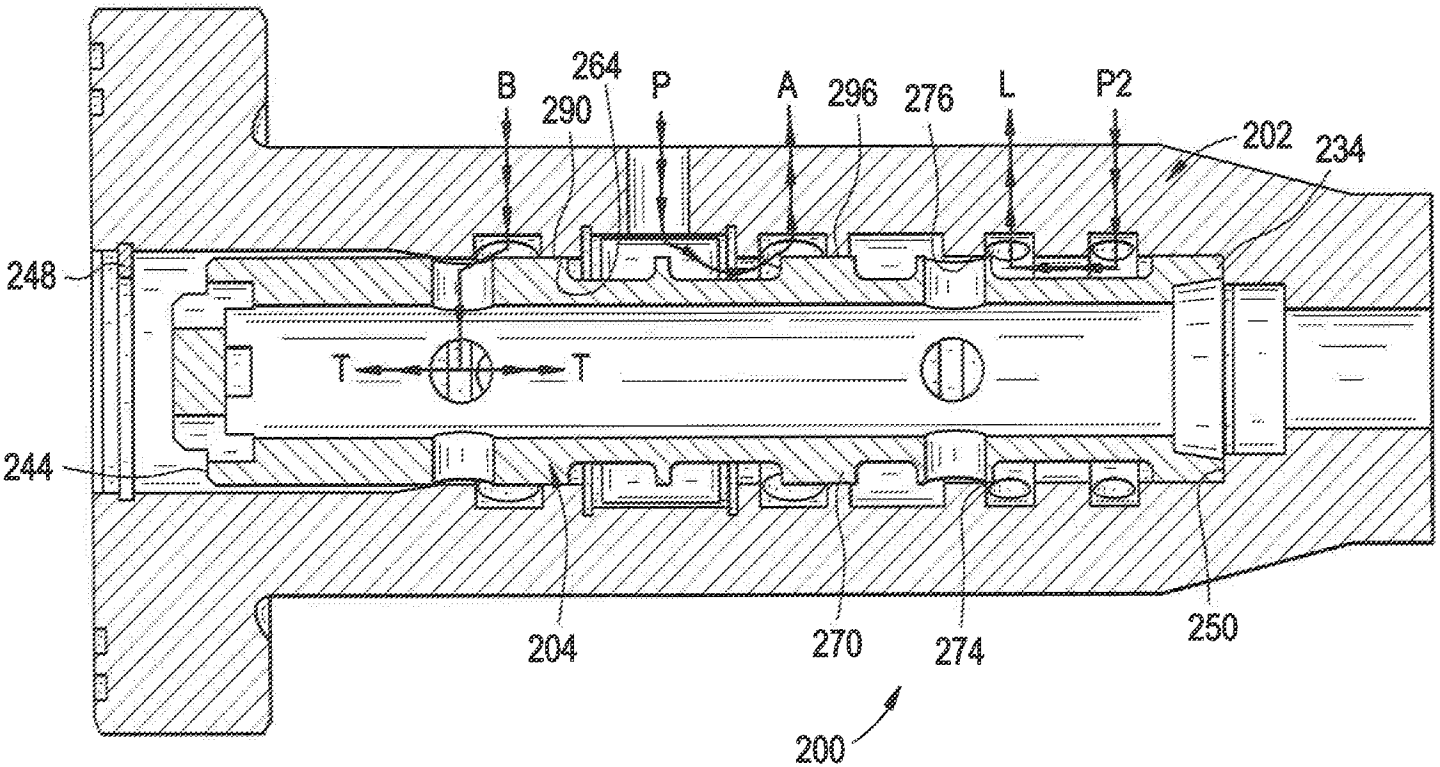
Figure 20:
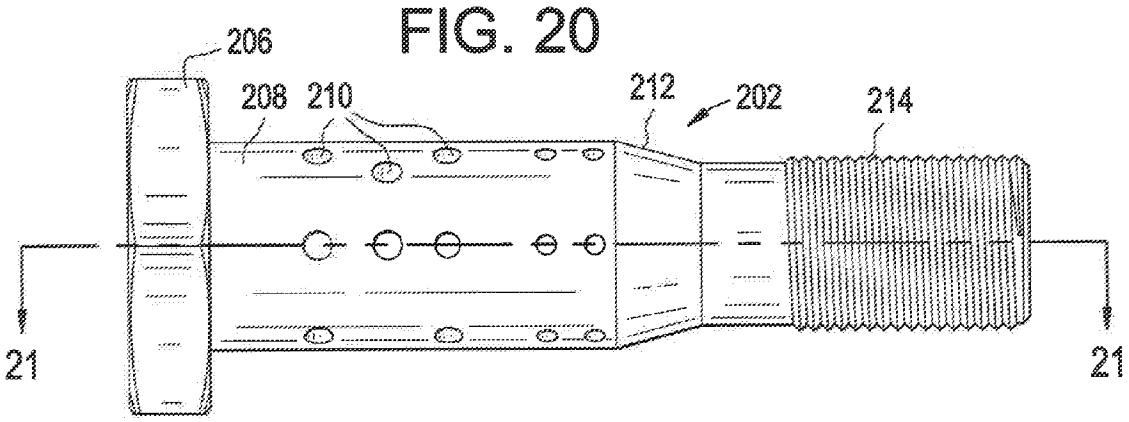
Figure 21:
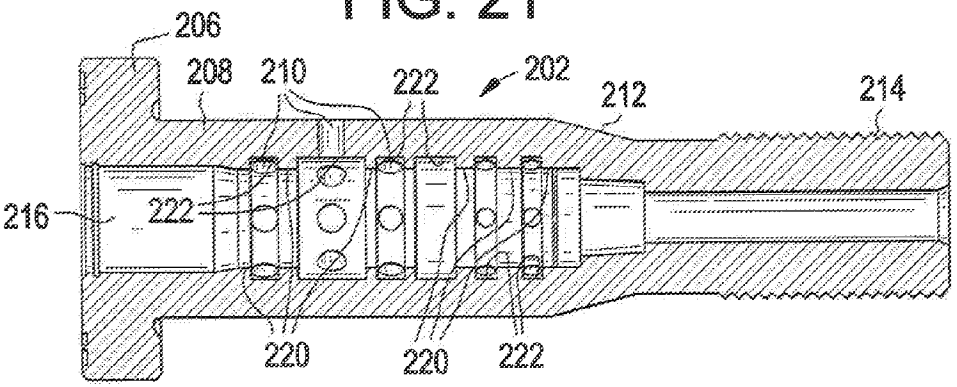
Figure 29:
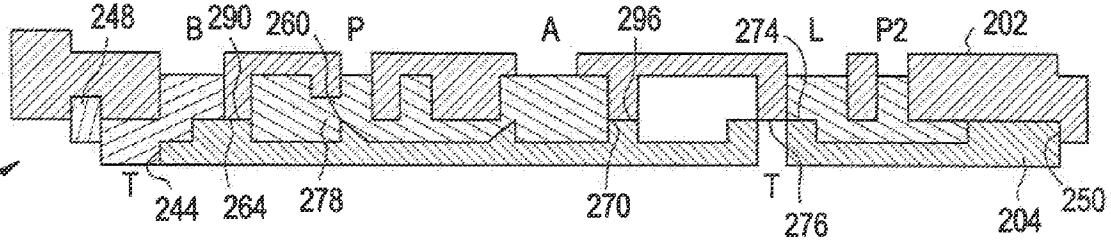
Figure 31:
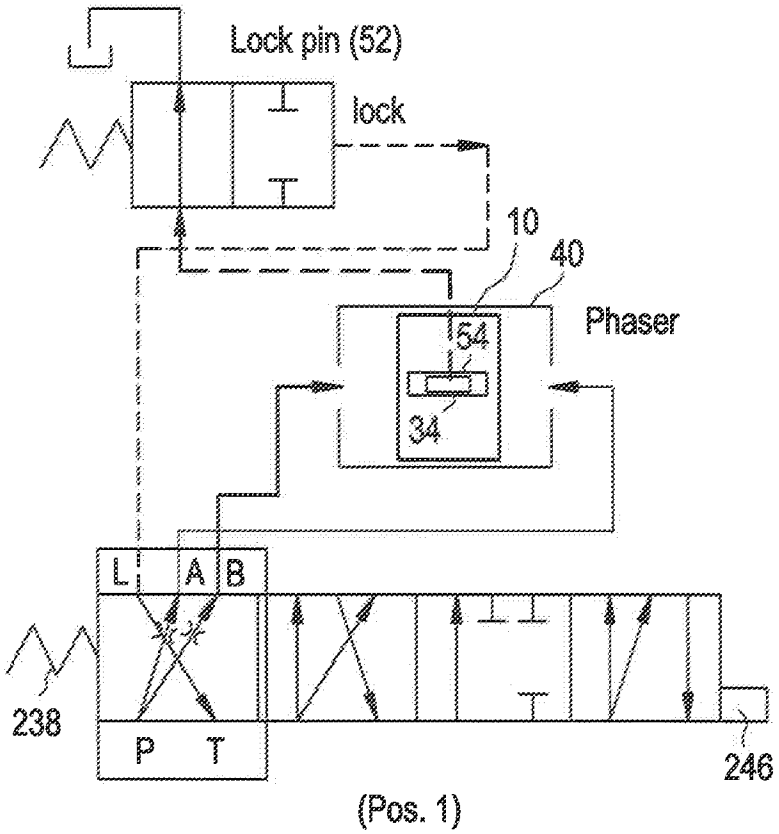
Figure 34:
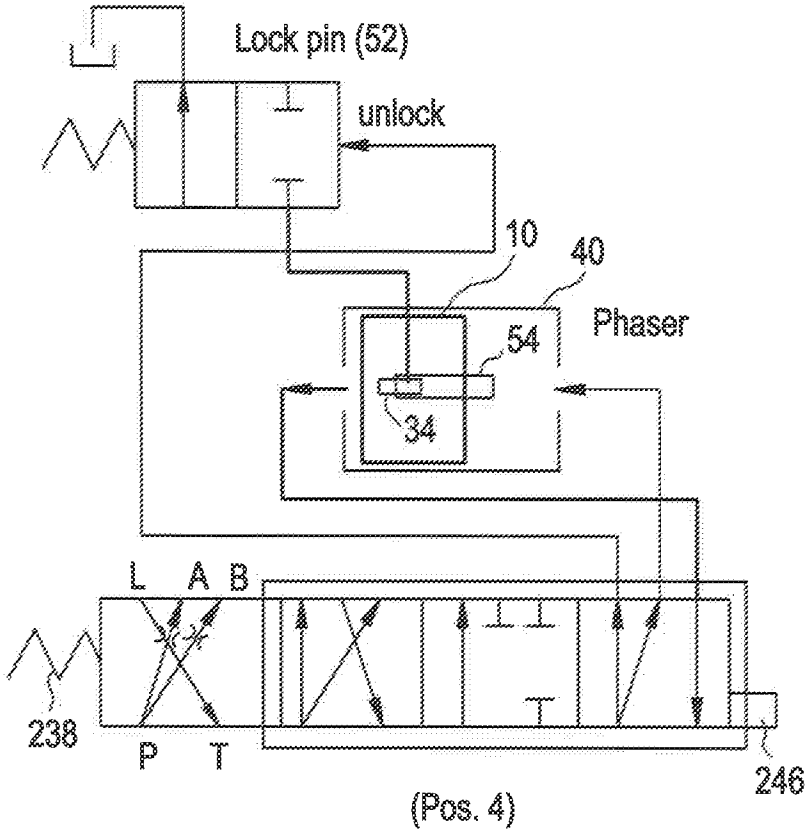

When the hydraulic valve 200 is in the position shown in FIG. 19, the spool 204 is further advanced such that there is more space (such as 3.7 mm) provided between the end 244 of the spool 204 and the snap ring 248. In this position, preferably the spool 204 is bottomed out and is in contact with the internal shoulder 250 within the bolt 202. Regardless, a fluid path is open between the supply pressure port (Pump or "P") and the retard chamber (chamber "A") of the phaser. The fluid path also remains open between the supply pressure (Pump or "P2") and the chamber beneath the lock pin 52 ("L"). This results in the rotor 10 moving to retard relative to the stator 40. The fluid flow during this state is generally depicted in FIG. 24 as position 2, and is depicted in FIGS. 29 and 34. As shown, the advance chamber (chamber "B") is allowed to drain to Tank ("T"). On the other hand, fluid flow from Pump ("P") to the advance chamber (chamber "B") of the cam phaser is prevented due to land 290 of the spool 204 being sized, shaped, configured and positioned relative to corresponding internal projection 264 of the bolt 202, such that fluid cannot flow past the interface. Furthermore, fluid flow from the retard chamber (chamber "A") of the cam phaser to Tank ("T") is prevented due to and 296 of the spool 204 being sized, shaped, configured and positioned relative to corresponding internal projection 270 of the bolt 202, such that fluid cannot flow past the interface. Finally, fluid flow from the lock pin 52 ("L") to Tank ("T") is prevented due to land 274 of the spool 204 being sized, shaped, configured and positioned relative to a corresponding internal projection 276 of the bolt 202, such that fluid cannot flow past the interface.

The hydraulic valve 200 which has been described is configured to limit flow during the self-centering operation of the cam phaser. This is important for the system function, since it allows the phaser to select a side (i.e., "A" or "B") to bleed off, reducing pressure on that side, which allows the phaser to move towards the mid-park (i.e., locking) position. While it has been described that lands of the spool can be configured (relative to the bolt) to provide for restricted flow during locking, this can be achieved several other ways such as with other types of fluid path geometries, such as with slots, grooves or other shapes on the spool, bolt, or other structure.

The present invention can take many, many forms. For example, the present invention can be provided in the form of a remotely mounted hydraulic valve. For example, if oil passages were provided in the cylinder head to mount the valve away from the camshaft, but still providing oil to the cam phaser instead of using the combination bolt/valve shown and described herein.

Figure 35:
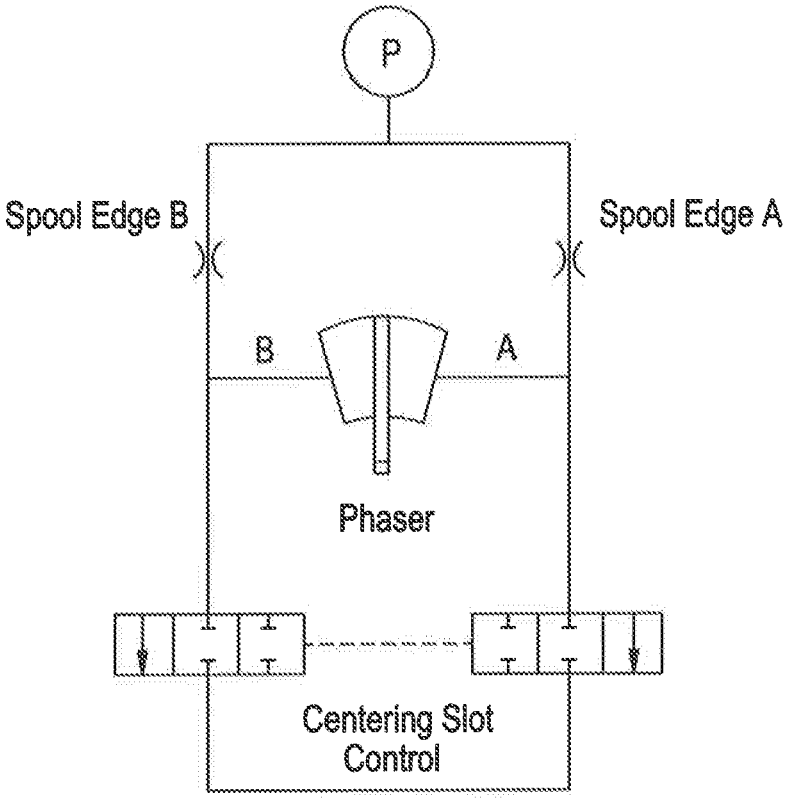
FIG. 35 shows a Wheatstone bridge in explaining, generally, the present invention.

The present invention can take many, many forms. One way to generally explain, conceptually, the present invention is to explain it as a Wheatstone bridge, commonly used in electronics. As shown in FIG. 35, the phaser takes the place of a galvanometer, across the bridge. The two sides of the centering slots form the two lower legs. The limited flow OCV metering features form the upper two legs. The goal is to maximize phasing rate, which requires pressure across the phaser. It can be mathematically shown that for any given combination of hydraulic phaser resistance, mechanical cam and phaser resistance (friction), and centering slot hydraulic resistances, there is a corresponding set of hydraulic resistances in the OCV A and B paths that will produce the maximum pressure across the phaser, and thus the highest phase rates. Thus, the A and B OCV resistances can be balanced and optimized to provide the best phase rate in both directions, depending on which centering slot control is open. Such a mathematical analysis shows that minimizing the hydraulic resistance in the OCV, which is a common goal for valves, actually reduces the pressure across the phaser, and slow the phase rates. Thus, as OCV resistances approach zero, the phase rate would approach zero too.

The described embodiments only involve exemplary configurations. A combination of the features described for different embodiments is also possible. Additional features, particularly those which have not been described, for the device parts belonging to the invention can be derived from the geometries of the device parts shown in the drawings.

While specific embodiments of the invention have been shown and described, it is envisioned that those skilled in the art may devise various modifications without departing from the spirit and scope of the present invention.

What is claimed is:

1. A hydraulic valve for use with a lockable cam phaser of an internal combustion engine which is lockable using a lock pin of pressure medium control valve, said hydraulic valve comprising:

a member; and a spool associated with the member and shiftable into a plurality of positions, said hydraulic valve configured to provide fluid passageways to and from the cam phaser, and said hydraulic valve configured to move the cam phaser to a lockable position by providing that pressure medium in a first chamber or second chamber of the cam phaser vents through the pressure medium control valve and out the cam phaser.

2. A hydraulic valve as recited in claim 1, wherein the spool has an external surface, wherein the member has an internal surface, wherein the external surface of the spool is configured to interface with the internal surface of the member such that fluid flow to the cam phaser is restricted during locking of the cam phaser.

3. A hydraulic valve as recited in claim 1, wherein the spool has an external surface, wherein the member has an internal surface, said external surface providing at least one land which is configured to interface with the internal surface of the member such that fluid flow to the cam phaser is restricted during locking of the cam phaser.

4. A hydraulic valve as recited in claim 1, wherein the hydraulic valve is configured to allow drainage of fluid from the lock pin while restricting fluid flow with regard to advance and retard chambers of the cam phaser.

5. A hydraulic valve as recited in claim 1, wherein the hydraulic valve is configured to operate in a plurality of different states, wherein in one state, fluid flow is restricted with regard to advance and retard chambers of the cam phaser, but fluid is allowed to drain from the lock pin through the hydraulic valve.

6. A hydraulic valve as recited in claim 5, wherein in another state, the hydraulic valve supplies fluid to the advance chamber of the cam phaser while allowing the retard chamber of the cam phaser to drain through the hydraulic valve.

7. A hydraulic valve as recited in claim 5, wherein. in another state, the hydraulic valve traps fluid in the advance and retard chambers of the cam phaser, and a fluid path remains open between supply pressure and the lock pin.

8. A hydraulic valve as recited in claim 5, wherein in another state, the hydraulic valve supplies fluid to the retard chamber of the cam phaser while allowing the advance chamber of the cam phaser to drain through the hydraulic valve.

9. A hydraulic valve as recited in claim 1, wherein the lockable cam phaser has a lock pin, wherein the hydraulic valve is configured to operate in a plurality of different states, wherein in one state of the hydraulic valve, fluid flow is restricted with regard to advance and retard chambers of the cam phaser, but fluid is allowed to drain from the lock pin through the hydraulic valve, wherein in another state of the hydraulic valve, the hydraulic valve supplies fluid to the advance chamber of the cam phaser while allowing the retard chamber of the cam phaser to drain through the hydraulic valve, wherein in another state of the hydraulic valve, the hydraulic valve traps fluid in the advance and retard chambers of the cam phaser, and a fluid path remains open between supply pressure and the lock pin, wherein in another state of the hydraulic valve, the hydraulic valve supplies fluid to the retard chamber of the cam phaser while allowing the advance chamber of the cam phaser to drain through the hydraulic valve.

10. A hydraulic valve in combination with a valve timing control device in an internal combustion engine, said valve timing control device comprising:

a rotor connected to a camshaft, said rotor comprising a plurality of vanes;

a stator engaged with the rotor, said stator comprising a plurality of webs, wherein at least one of said rotor and said stator comprises a centering opening, and wherein chambers are provided between each of the webs and vanes;

a pressure medium control valve comprising a lock pin in one of said vanes of said rotor, wherein said pressure medium control valve is configured to selectively lock and unlock a position of said rotor relative to said stator, wherein the valve timing control device is configured such that said chambers are ventable through said centering opening and thereafter through said pressure medium control valve, depending on the position of the rotor; and wherein said hydraulic valve is configured to move the rotor to a lockable position by providing that pressure medium in a first chamber or second chamber of the cam phaser vents through the pressure medium control valve and out the rotor.

11. A hydraulic valve in combination with a valve timing control device in an internal combustion engine, as recited in claim 10, wherein the hydraulic valve is configured to allow pressure medium to drain from the pressure medium control valve of the valve timing control device, through the hydraulic valve, while the hydraulic valve restricts flow of pressure medium to the chambers during locking of the pressure medium control valve.

12. A hydraulic valve in combination with a valve timing control device in an internal combustion engine, as recited in claim 10, wherein the rotor of the valve timing control device is configured such that it is positionable to render the centering opening inaccessible to the chambers, wherein the rotor of the valve timing control device is configured such that it is positionable to at least partially cover the centering opening on the stator, and wherein the rotor of the valve timing control device is configured such that it is positionable to frilly cover the centering opening on the stator.

13. A hydraulic valve in combination with a valve timing control device in an internal combustion engine, as recited in claim 10, wherein the lock pin is configured to provide a pressure medium fluid path through the lock pin and to the hydraulic valve.

14. A hydraulic valve in combination with a valve timing control device in an internal combustion engine, as recited in claim 10, wherein the spool of the hydraulic valve has an external surface, wherein the member of the hydraulic valve has an internal surface, wherein the external surface of the spool is configured to interface with the internal surface of the member such that fluid flow to the chambers is restricted daring locking of the pressure medium control valve of the valve timing control device.

15. A hydraulic valve in combination with a valve timing control device in an internal combustion engine, as recited in claim 10, Wherein the spool of the hydraulic valve has an external surface, wherein the member of the hydraulic valve has an internal surface, said external surface of the spool providing at least one land which is configured to interface with the internal surface of the member such that fluid flow to the chambers is restricted during locking of the pressure medium control valve.

16. A hydraulic valve in combination with a valve timing control device in an internal combustion engine, as recited in claim 10, wherein the hydraulic valve is configured to allow drainage of pressure medium from the pressure medium control valve while restricting fluid flow with regard to the chambers.

17. A hydraulic valve in combination with a valve timing control device in an internal combustion engine, as recited in claim 10, wherein the hydraulic valve is configured to operate in a plurality of different states, wherein in one state, fluid flow is restricted with regard to the chambers, but pressure medium is allowed to drain from the pressure medium control valve through the hydraulic valve.

18. A hydraulic valve in combination with a valve timing control device in an internal combustion engine, as recited in claim 11, wherein the hydraulic valve is configured to operate in another state, wherein the hydraulic valve supplies fluid to an advance chamber while allowing a retard chamber to drain through the hydraulic valve.

19. A hydraulic valve in combination with a valve timing control device in an internal combustion engine, as recited in claim 11, wherein the hydraulic valve is configured to operate in another state, wherein the hydraulic valve traps pressure medium in advance and retard chambers, while a pressure medium fluid path remains open between supply pressure and the pressure medium control valve.

20. A hydraulic valve in combination with a valve timing control device in an internal combustion engine, as recited in claim 11, wherein the hydraulic valve is configured to operate in another state, wherein the hydraulic valve supplies pressure medium to a retard chamber while allowing an advance chamber to drain through the hydraulic valve.

21. A hydraulic valve in combination with a valve timing control device in an internal combustion engine, as recited in claim 10, wherein the hydraulic valve is configured to operate in a plurality of different states, wherein in one state, fluid flow is restricted with regard to the chambers, but pressure medium is allowed to drain from the pressure medium control valve through the hydraulic valve, wherein in another state, the hydraulic valve supplies pressure medium to an advance chamber while allowing a retard chamber to drain through the hydraulic valve, wherein in another state, the hydraulic valve traps pressure medium in the advance and retard chambers, while a pressure medium fluid path remains open between supply pressure and the pressure medium control valve, wherein in another state, the hydraulic valve supplies pressure medium to the retard chamber while allowing the advance chamber to drain through the hydraulic valve.

22. A hydraulic valve in combination with a valve timing control device in an internal combustion engine, as recited in claim 21, wherein the pressure medium control valve is configured to exist in a first state, a second state, a third state, and a fourth state, wherein:

during the first state, the lock pin of the pressure medium control valve engages the stator and locks a position of the rotor relative to the stator, pressure medium is ventable from the pressure medium control valve out the rotor, pressure medium throttles to the chambers, and the rotor is positioned such that the centering opening is inaccessible to the chambers;

during the second state, the lock pin of the pressure medium control valve is disengaged from the stator, and the pressure medium control valve is configured to prevent pressure medium from venting from the pressure medium control valve;

during the third state, the lock pin of the pressure medium control valve is disengaged from the stator, thereby providing that the rotor is moveable relative to the stator, wherein the rotor is positioned such that the centering opening is accessible to at least one the chambers, and the pressure medium control valve is configured such that pressure medium is veritable from said at least one chamber, along the centering opening, into the pressure medium control valve, and out the rotor; and during the fourth state, the lock pin of the pressure medium control valve engages the stator, thereby locks a position of the rotor relative to the stator, the pressure medium control valve is configured such that pressure medium is ventable from the pressure medium control valve, pressure medium throttles to the chambers, and the rotor is positioned such that the centering opening is inaccessible to the chambers.

* * * * *